US010031455B2

(12) United States Patent
Tanaka et al.

(10) Patent No.: US 10,031,455 B2
(45) Date of Patent: Jul. 24, 2018

(54) IMAGE FORMING APPARATUS

(71) Applicant: CANON KABUSHIKI KAISHA, Tokyo (JP)

(72) Inventors: Masanobu Tanaka, Kashiwa (JP); Oki Kitagawa, Nagareyama (JP); Akiyoshi Shinagawa, Kasukabe (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/882,184

(22) Filed: Jan. 29, 2018

(65) Prior Publication Data

US 2018/0150004 A1 May 31, 2018

Related U.S. Application Data

(60) Division of application No. 15/476,434, filed on Mar. 31, 2017, which is a continuation of application No. PCT/JP2015/079104, filed on Oct. 7, 2015.

(30) Foreign Application Priority Data

Oct. 7, 2014 (JP) ..... 2014-206271
Oct. 7, 2014 (JP) ..... 2014-206272

(51) Int. Cl.
*G03G 15/20* (2006.01)

(52) U.S. Cl.
CPC ..... *G03G 15/2075* (2013.01); *G03G 15/2085* (2013.01)

(58) Field of Classification Search
CPC ..... G03G 15/2075; G03G 15/2085
See application file for complete search history.

(56) References Cited

U.S. PATENT DOCUMENTS 5,138,390 A 8/1992 Miyabayashi et al.
9,494,903 B2 * 11/2016 Shinagawa ..... G03G 15/2025
(Continued)

FOREIGN PATENT DOCUMENTS

JP 02-160276 A 6/1990
JP 2003-057985 A 2/2003
(Continued)

OTHER PUBLICATIONS

PCT International Search Report and Written Opinion dated Dec. 8, 2015, in PCT/JP2015/079104, and partial translation.
(Continued)

*Primary Examiner* — Ryan Walsh
(74) *Attorney, Agent, or Firm* — Fitzpatrick, Cella, Harper & Scinto

(57) ABSTRACT

An image forming apparatus includes an image forming portion forming a toner image on a sheet, a rotatable heating member and a rotatable pressing member for fixing, at a nip, the toner image formed on the sheet by the image forming portion, an executing portion for executing a cleaning mode for cleaning the rotatable heating member by introducing, into the nip, the sheet on which a predetermined toner image is formed by the image forming portion, a re-introducing mechanism for re-introducing the sheet, into the nip, which has passed through the nip and then has been turned upside down, and a shifting mechanism for shifting a sheet position so that when a single sheet is introduced twice into the nip in the cleaning mode by using the re-introducing mechanism, positional relationships of a first-time sheet and a second-time sheet relative to the rotatable heating member with respect to a widthwise direction of the rotatable heating member are made different from each other.

2 Claims, 22 Drawing Sheets

(56) References Cited

U.S. PATENT DOCUMENTS

| | | | | |
|---|---|---|---|---|
| 2007/0140757 | A1* | 6/2007 | Poxon | G03G 21/0041 399/327 |
| 2009/0052963 | A1* | 2/2009 | Kawai | G03G 15/6573 399/395 |
| 2011/0268482 | A1* | 11/2011 | Akamatsu | G03G 15/2025 399/327 |
| 2012/0148286 | A1* | 6/2012 | Hirai | G03G 15/161 399/71 |

FOREIGN PATENT DOCUMENTS

| | | | |
|---|---|---|---|
| JP | 2004-205677 | A | 7/2004 |
| JP | 2009-103789 | A | 5/2009 |
| JP | 2010-033018 | A | 2/2010 |
| JP | 2011-180412 | A | 9/2011 |
| JP | 2012-128263 | A | 7/2012 |
| JP | 2015-075671 | A | 4/2015 |

OTHER PUBLICATIONS

Office Action dated Apr. 17, 2018, issued in Japanese Patent Application No. 2014-206271.

* cited by examiner

| HEATING BELT 130 POSITION | +3.0mm | +1.0mm | -1.0mm | -3.0mm |
|---|---|---|---|---|
| | REAR | | FRONT | |
| | REST | CHANGED | CHANGED | REST |
| SENSOR 150a | OFF | ON | OFF | OFF |
| SENSOR 150b | OFF | ON | ON | OFF |
| ROTATIONAL DIRECTION | – | CW | CCW | – |
| STEERING ROLLER ANGLE | -2 | -2 | 2 | 2 |

IMAGE FORMING APPARATUS

This application is a divisional application of U.S. patent application Ser No. 15/476,434, filed Mar. 31, 2017, which is a continuation of International Application No. PCT/JP2015/079104, filed Oct. 7, 2015.

TECHNICAL FIELD

The present invention relates to an image forming apparatus, such as a copying machine or a printer, of an electrophotographic type.

BACKGROUND ART

In the image forming apparatus of the electrophotographic type, a fixing device for fixing an unfixed toner image, as a fixed image, formed on a sheet is mounted. Here, a heating roller and a heating belt are referred to as rotatable heating members (rotatable fixing members), and a pressing roller and a pressing belt are referred to as rotatable pressing members.

Recently, as the sheet, a sheet containing heavy calcium carbonate as a filler in a large amount has been used. In order to enhance a texture of the sheet, there is a tendency to increase a filling amount of the calcium carbonate for the reason that the resultant sheet has high whiteness, excellent opacity, inexpensiveness, and the like. However, sheet powder (paper powder) principally comprising calcium carbonate and generating on such a sheet is liable to be triboelectrically charged compared with sheet powder principally comprising another filler such as kaolin or talc.

For that reason when the sheet containing calcium carbonate in the large amount passes through a nip, the sheet powder is liable to be electrostatically attracted to a surface of the rotatable heating member. Thus, when the sheet powder is deposited on the surface of the rotatable heating member, toner is gradually accumulated at that portion. When an accumulation amount of the toner increases, there is a liability that the toner is transferred onto the sheet or the like and causes an image defect.

Therefore, in order to solve such a problem, in Japanese Laid-Open Patent Application 2009-103789, a method of using a solid image-printed sheet as a cleaning sheet (hereinafter referred to as a cleaning sheet) has been proposed. Specifically, by using a depositing force between toners (toner particles), the accumulated toner is transferred onto a solid image portion of the cleaning sheet, so that the rotatable heating member is cleaned.

However, even when the solid image-printed cleaning sheet is simply introduced into the nip, there is a limit to a cleaning effect on the surface of the rotatable heating member. This is because the sheet powder deposited on the rotatable heating member generates from end portions of the sheet with respect to a widthwise direction in a large amount. That is, on the surface of the rotatable heating member, the sheet powder accumulates move in both widthwise end sides than in a contact region with the sheet. Accordingly, the both end portions of the rotatable heating member with respect to the widthwise direction cannot be properly cleaned, and there is a liability that it leads to a factor of the image defect.

SUMMARY OF THE INVENTION

According to an aspect of the present invention, there is provided an image forming apparatus comprising: an image forming portion for forming a toner image on a sheet; a rotatable heating member and a rotatable pressing member for fixing, at a nip, the toner image formed on the sheet by the image forming portion; an executing portion for executing cleaning mode for cleaning the rotatable heating member by introducing, into the nip, the sheet on which a predetermined toner image is formed by the image forming portion; and a changing mechanism for making positional relationships of a first sheet and a second sheet relative to the rotatable heating member different from each other with respect to a widthwise direction of the rotatable heating member when the first sheet and the second sheet are successively introduced into the nip in the cleaning mode.

EMBODIMENTS FOR CARRYING OUT THE INVENTION

In the following, the present invention will be described more specifically. Incidentally, each of these embodiments is an example of best modes of the present invention, but the present invention is not limited to various constitutions described in these embodiments. That is, the constitutions described in the embodiments can be replaced with other known constitutions within the scope of the concept of the present invention.

<Embodiment1>

In Embodiment 1, in an image forming apparatus including a fixing device of a roller type, a sheet (recording material) for cleaning is fed using a sheet shifting mechanism provided upstream of a transfer portion.

(1-1) General Structure of Image Forming Apparatus

Figure 1:
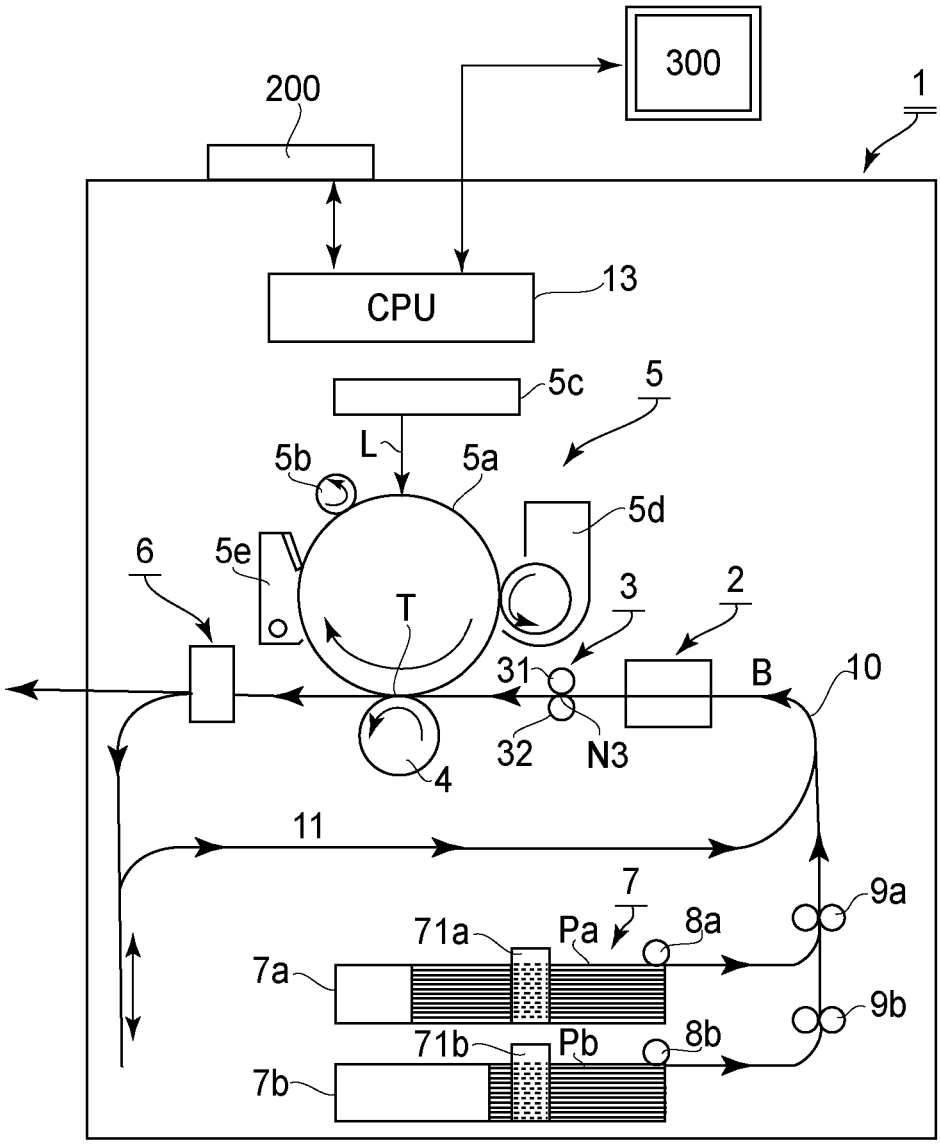
FIG. 1 is a schematic structural view of an image forming apparatus in embodiments.

FIG. 1 is a schematic structural view of an example of an image forming apparatus 1 according to this Embodiment 1. This image forming apparatus 1 is an electrophotographic laser beam printer. That is, the image forming apparatus 1 is capable of forming an outputting, on a recording material (hereinafter referred to as a sheet) P (Pa, Pb), a toner image corresponding to electrical image information inputted from a host device 300 communicatably network-connected with a CPU (controller: executing device) 13.

Figure 8:
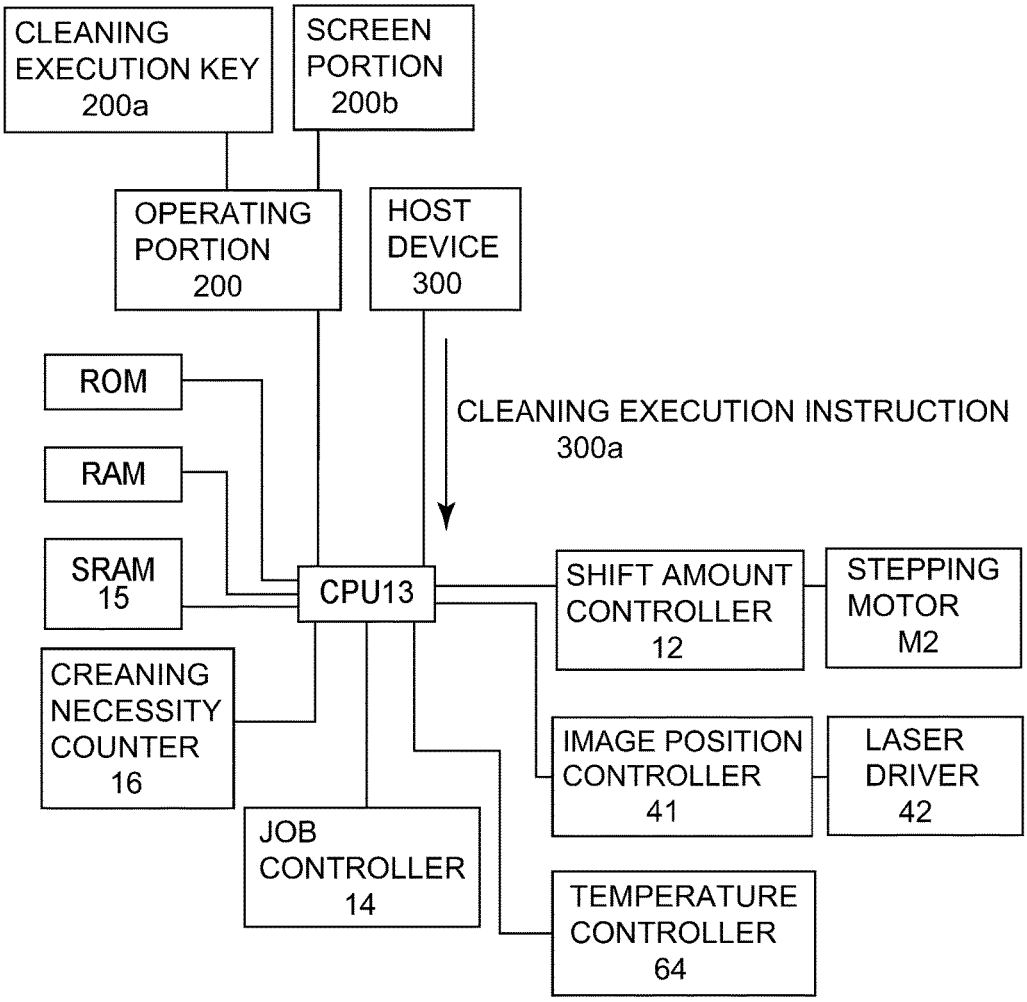
FIG. 8 is a control black diagram relating to the cleaning mode in Embodiment 1.

FIG. 8 is a control block diagram in this embodiment. The CPU 13 controls a shift amount controller 12, an image position controller 41, a job managing portion (controller) 14, and the like on the basis of an input signal from an operating portion (console portion) 200 or the host device 300. The host device 300 is personal computer (PC), an image reader, a facsimile or the like. The shift amount controller 12 controls a sheet shifting mechanism (changing mechanism: recording material position controlling mechanism) 3 described later. The image position controller 41 controls a laser scanner 5*c* described later.

Inside the apparatus 1, in the order from an upstream side (recording material feeding direction upstream side) toward a downstream side with respect to a sheet feeding direction of a sheet feeding path, a sheet feeding mechanism 7, a sheet obliquely feeding mechanism 2, the sheet shifting mechanism 3, an image forming portion 5, a fixing device (fixing portion) 6, and the like are provided.

The image forming portion 5 is an image forming means for forming an unfixed toner image on an image bearing member 5*a* and for transferring the toner image on the sheet P. In this embodiment, the image forming portion 5 is a transfer-type electrophotographic image forming contact. The image forming portion 5 includes a drum-type electrophotographic photosensitive member (hereinafter referred to as a drum) 5*a* as the image bearing member. The drum 5*a* is rotationally driven in the clockwise direction of an arrow at a predetermined speed (process speed) by a driving portion (not shown). Further, at a periphery of the drum 5*a*, as process means actable on the drum 5*a*, a charger 5*b*, an image exposure device 5*c*, a developing device 5*d*, a transfer device 4, and a cleaning device 5*e* are provided along a develop rotational direction.

The charger 5*b* is a charging means for electrically charging a surface of the rotating drum 5*a* to a predetermined polarity and a predetermined potential, and is a contact charging roller (electroconductive roller) to which a predetermined charging bias is applied from an electric power source portion (not shown) in this embodiment.

The exposure device 5*c* is an image exposure means for subjecting the charged surface to image exposure corresponding to image information. In this embodiment, the exposure device 5*c* is a laser scanner into which an image signal is inputted from the CPU 13. The scanner 5*c* scans the drum surface with laser light, emitted from a laser light source and modulated correspondingly to the image signal, while rotating a polygon mirror, and flux of scanning light is polarized by a reflection mirror and is focused on a generatrix of the drum 5*a* by fθ lens, so that exposure of the drum surface to light L is effected. As a result, an electrostatic latent image of an image pattern corresponding to the image signal is formed on the drum surface charged uniformly to the predetermined polarity and the predetermined potential by the charger 5*b*.

The developing device 5*d* is a developing means for visualizing (developing) the electrostatic latent image, formed on the surface of the drum 5*a*, into an unfixed toner image with toner (developer).

The transfer device 4 is a toner image transfer means for transferring the toner image, formed on the drum 5*a*, onto the sheet P fed to a transfer position T of the image forming portion 5. In this embodiment, the transfer device 4 is a transfer roller (electroconductive roller) to which a predetermined transfer bias is applied from a power (voltage) source portion (not shown). The transfer roller 4 is press-contacted to the drum 5*a* with a predetermined pressing force. The press-contact portion is a transfer position (toner image transfer portion, hereinafter referred to as a transfer nip) T. The cleaning device 5*e* is a drum cleaning means for cleaning the drum surface by removing a residual deposited matter such as transfer residual toner from the drum 5*a* surface after the toner image transfer onto the sheet P.

The sheet feeding mechanism 7 is a sheet feeding means for feeding the sheet P to the transfer nip T of the image forming portion 5. The mechanism 7 in this embodiment includes first and second cassettes 7*a*, 7*b* which constitute upper and lower two stages as a sheet accommodating portion. In the cassettes 7*a*, 7*b*, plural sheets P (Pa, Pb) different in size are accommodated, respectively, while being regulated by size regulating plates (side guiding plates) so as to be stacked in parallel to the sheet feeding direction.

Here, upper and lower are those with respect to a direction of gravitation. In the apparatus of this embodiment, feeding of the sheet P during image formation is carried out by so-called center-basis feeding on the basis of a widthwise center for any of sheets P having various sizes including large and small sizes.

When a print job is inputted from the operating portion 200 or the device 300 into the CPU 13, a separation roller (feeding roller) 8*a* or 8*b* for the cassette 7*a* or 7*b* in which the sheets P having a designated size are accommodated is driven. By this, the sheet P is separated one by one from the cassette 7*a* or 7*b* and is passed through a sheet feeding path 10, and then is introduced into the obliquely feeding mechanism 2. The obliquely feeding mechanism 2 is a mechanism for correcting (rectifying) oblique movement of the sheet P. The obliquely feeding mechanism 2 will be described specifically in section (1-2).

The sheet P coming out of the obliquely feeding mechanism 2 is moved by the sheet shifting mechanism 3 in a predetermined shift amount in a sheet widthwise direction which is a direction perpendicular to a sheet feeding direction (recording material feeding direction) B in a plane of the sheet feeding path. Then, the sheet P shifted by the sheet shifting mechanism 3 in a predetermined manner is introduced into the transfer nip T of the image forming portion 5, and is successively subjected to transfer of the unfixed toner image from the drum 5*a* side. The sheet shifting mechanism 3 will be described specifically in section (1-3).

The shifting mechanism P coming out of the transfer nip T is successively separated (peeled off) from the surface of the drum 5*a* and is introduced into the fixing device 6. Then, in the fixing device 6, the toner image is fixed as a fixed image on the sheet P by heat and pressure. The sheet P on which the image is fixed in the fixing device 6 enters a discharge feeding path and is discharged to an outside of the apparatus in the case of a one-side printing mode. The fixing device 6 will be described specifically in section (1-4).

In the case of a double-side printing mode, the sheet P on which the image has already been formed on a first side (first surface) and which come out of the fixing device 6 is introduced into a double-side feeding path (double-side path portion) 11 in which the sheet P is turned upside down, and is fed toward the obliquely feeding mechanism 2 again. Then, the toner image is transferred and formed on a second side (second surface) of the sheet P at the transfer portion T. The sheet P is introduced into the fixing device 6 again, so that the toner image formed on the second side is fixed. The sheet P is discharged as a double-side image-formed product to the outside of the apparatus.

(1-2) Oblique Feeding Mechanism 2

Figure 2:
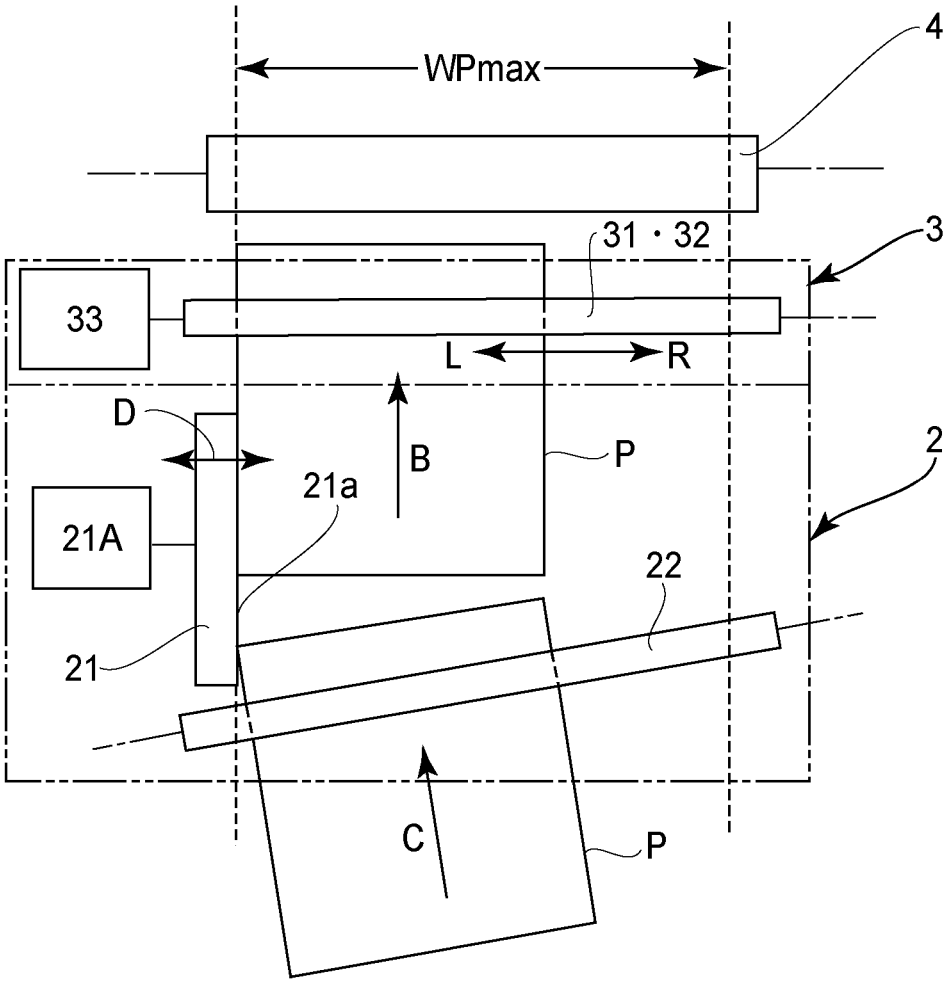
FIG. 2 is a schematic view of an obliquely feeding mechanism, a sheet shifting mechanism and a transfer roller in Embodiments 1 and 2.

FIG. 2 is a schematic plan view of portions of the obliquely feeding mechanism 2, the sheet shifting mechanism 3 and the transfer roller 4. With regard to the sheet P fed from the sheet feeding mechanism 7 to the feeding path 10, the obliquely feeding mechanism 2 carries out not only oblique movement correction before the sheet P enters the sheet shifting mechanism 3 but also registration (lateral registration) of the sheet P with respect to the sheet widthwise direction perpendicular to the sheet feeding direction B.

WPmax is a maximum width size of the sheet P usable (feedable) in the apparatus 1. The obliquely feeding mechanism 2 includes an obliquely feeding roller 22 consisting of an abutting plate 21 and a sheet feeding roller pair as a pair of upper and lower rollers. The plate 21 is provided in one side of the portion of the sheet maximum width size WPmax in the sheet feeding path 10, and an inner surface side is a regulating surface 21*a* for abutting a sheet side edge against it. The regulating surface 21*a* is a surface parallel to the sheet feeding direction B.

The plate 21 is disposed movable (positional adjustable) in a direction D (sheet widthwise direction) perpendicular to the sheet feeding direction B by a shifting mechanism 21A including a stepping motor (not shown) controlled by the CPU 13.

The obliquely feeding roller 22 is provided upstream of the plate 21 with respect to the sheet feeding direction B. The obliquely feeding mechanism 2 includes a drive mechanism portion (not shown) for rotationally driving the obliquely feeding roller 22 and a switching mechanism portion (not shown) for switching the upper and lower roller pair between a contact state in which the roller pair is contacted to each other with predetermined nip pressure and a spaced state in which the roller pair is spaced from each other. The drive mechanism portion and the switching mechanism portion are controlled by the CPU 13.

The obliquely feeding roller 22 is provided by tilting a rotational axis direction relative to the sheet feeding direction B so that the sheet P fed from the feeding mechanism 7 is shifted and moved toward the regulating surface 21*a* side of the abutting plate 21 while being sandwiched and nipped. By this, the sheet P is obliquely fed in an arrow C direction toward the abutting plate 21 by the obliquely feeding roller 22. The obliquely feeding roller 22 is set so as to have a nip pressure weak to a predetermined degree. For this reason, even when the sheet P is obliquely moved and fed from the feeding mechanism 7 side, oblique movement of the sheet P is corrected by movement of the sheet P along the regulating surface 21*a* of the abutting plate 21 while the sheet P is rotated. Further, the lateral registration of the sheet P is carried out.

The sheet P subjected to correction of the oblique movement and the lateral registration by the obliquely feeding mechanism 2 reaches a nip between a shifting roller pair 31, 32 as a pair of upper and lower rollers of the sheet shifting mechanism 3 and is sandwiched between the roller pair 31, 32. The CPU 13 spaces the pair of obliquely feeding rollers 22 from each other by an operation of the switching mechanism at timing when a leading end portion of the sheet P reaches the roller pair 31, 32 and is sandwiched between the roller pair 31, 32. The above timing can be calculated (computed) from a feeding speed and size (dimension with respect to the feeding direction) of the sheet P.

Alternatively, it is also possible to employ a constitution in which a sensor for detecting that the leading end portion of the sheet P reaches the roller pair 31, 32 and is sandwiched between the roller pair 31, 32 is provided and the pair of obliquely feeding rollers 22 is spaced from each other by operating the switching mechanism on the basis of a sheet detection signal inputted from the sensor.

The pair of obliquely feeding rollers 22 is spaced from each other, so that the sandwiching of the sheet P by the obliquely feeding rollers 22 is eliminated. By this, movement of the sheet P by the sheet shifting mechanism 3 in a predetermined amount in the sheet widthwise direction perpendicular to the sheet feeding direction B described subsequently is carried out without being obstructed by the obliquely feeding rollers 22.

(1-3) Sheet Shifting Mechanism

The sheet shifting mechanism 3 (active registration mechanism, hereinafter referred to as a shifting mechanism) is provided for adjusting a feeding position of the sheet P with respect to the widthwise direction (longitudinal direction) of the transfer nip T to suppress an image position variation on the sheet due to a feeding position variation or the like. Further, there is a model in which a relative position of the sheet to a fixing member with respect to the widthwise direction during passing of the sheet through the fixing nip is shifted every sheet by the shifting mechanism 3 similar to that of the image forming apparatus 1 in this embodiment and abrasion of the fixing member surface by burns of the sheet end portions with respect to the widthwise direction is alleviated.

The shifting mechanism 3 is disposed upstream of the transfer nip T of the image forming portion 5 with respect to the sheet feeding direction and receives the sheet P subjected to the oblique movement correction and the lateral registration by the obliquely feeding mechanism 2. In order to align the sheet P with a main-scanning position (generatrix direction of the drum 5*a*) of the image on the drum 5*a*, the sheet P is fed toward the transfer nip T while moved in a main scan direction. That is, the sheet fed toward the transfer nip T is moved in a shift amount described later in the sheet widthwise direction perpendicular to the sheet feeding direction B.

Figure 3:
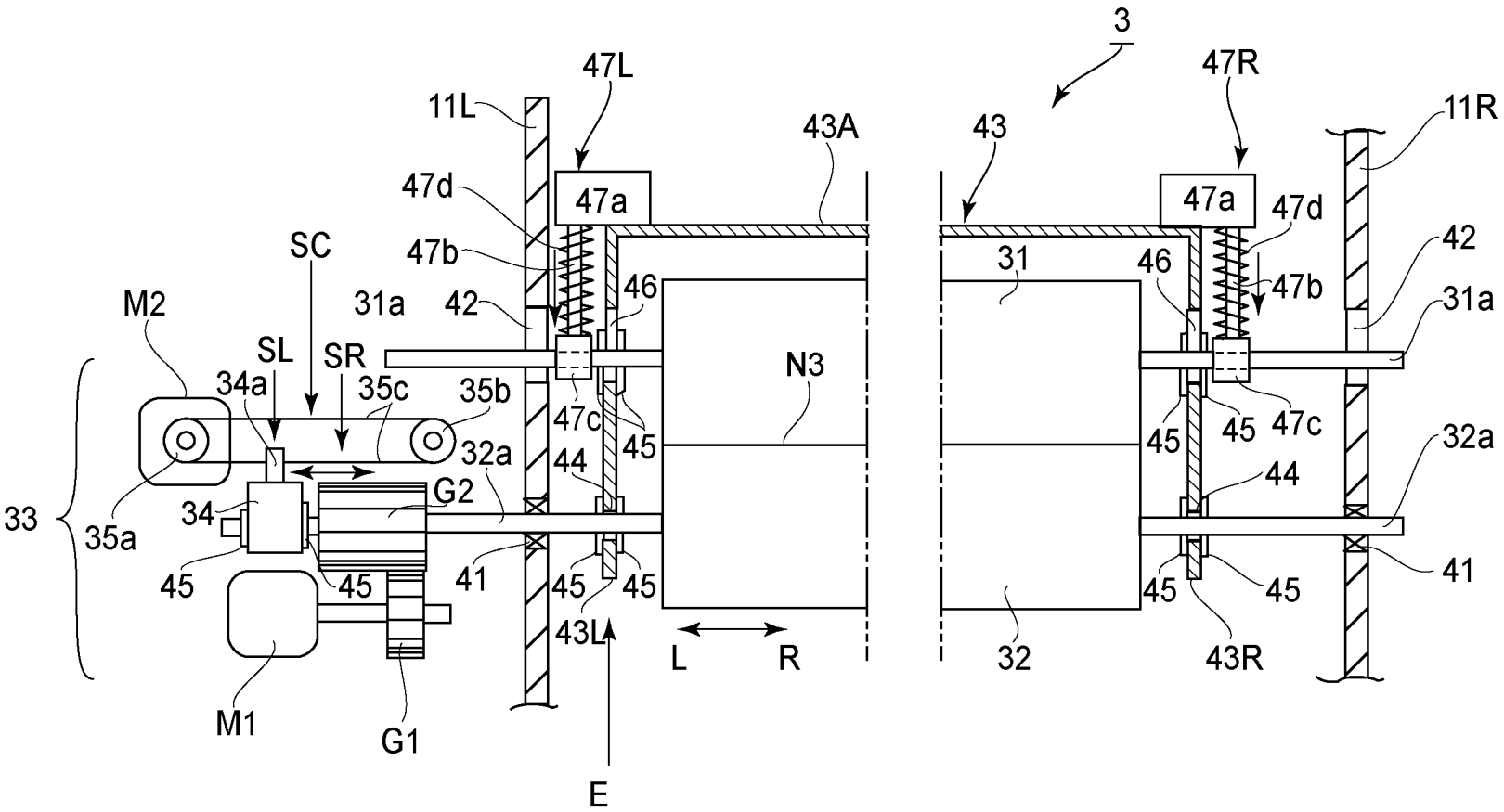
FIG. 3 is an illustration of the sheet shifting mechanism.

FIG. 3 is an illustration of the shifting mechanism 3. The shifting mechanism 3 includes the pair of shifting rollers 31, 32 which are upper and lower parallel rollers provided so that the rotational axis direction is the sheet widthwise direction perpendicular to the sheet feeding direction B.

One end side and the other end side of a shaft 32*a* of the lower-side roller 32 are supported via having members 41 by fixed apparatus frame plates 11L, 11R, respectively, so as to be rotatable and slidable (movable) in a thrust direction. One end side and the other end side of a shaft 31*a* of the upper-surface roller 31 are inserted into elongated holes 42 provided in the apparatus frame plates 11L, 11R, respectively, with respect to an up-down direction so as to be rotatable and slidable (movable) along the elongated holes 42 in the up-down direction.

Here, in this embodiment, one side or one end side is a left-hand side in FIG. 3, and the other side or the other end side is a right-hand side. In the following description, the one side or the one end side is referred to as a left side or a left end side, and the other side or the other end side is referred to as a right side or a right end side.

The rollers 31 and 32 are connected by a connecting frame 43 between the apparatus frame plates 11L, 11R. The frame 43 includes an upper-side plate portion 43A long in a left-right direction and left-and-right foot plate portions 43L, 43R bent downward by 90° in left-and-right sides of the upper-side plate portion 43A.

The left side of the shaft 32*a* of the lower-side roller 32 is inserted rotatably in a circular hole 44 provided in the left-side foot plate portion 43L, and movement thereof in a thrust direction relative to the foot plate portion 43L is prevented by a stopper ring 45. Further, the roller side of the shaft 32*a* is inserted rotatably in a circular hole 44 provided in the right-side foot plate portion 43R, and movement thereof in a thrust direction relative to the foot plate portion 43R is prevented by a stopper ring 45.

The left side of the shaft 31*a* of the upper-side roller 31 is inserted in the elongated hole 46 provided in the left-side foot plate portion 43L with respect to the up-down direction so as to be rotatable in the elongated hole 46 and slidable (movable) in the up-down direction along the elongated hole 46. Further, movement of the left side of the shaft 31*a* in the thrust direction relative to the foot plate portion 43L is prevented by the stopper ring 45. Further, the right side of the shaft 31*a* of the upper-side roller 31 is inserted in the elongated hole 46 provided in the right-side foot plate portion 43R with respect to the up-down direction so as to be rotatable in the elongated hole 46 and slidable (movable) in the up-down direction along the elongated hole 46, and further, movement of the left side of the shaft 31*a* in the thrust direction relative to the foot plate portion 43R is prevented by the stopper ring 45.

At left-and-right portions of the frame 43, roller contact-and-separation mechanisms 47L, 47R for moving the upper-side roller 32 toward and away from the lower-side roller 32 are provided, respectively. In this embodiment, each of the contact-and-separation mechanisms 47L, 47R is an electro-magnetic solenoid plunger. That is, at the left-and-right portions of the frame 43, solenoids 47*a* are fixedly provided, respectively. A plunger 47*b* of each of the left-and-right solenoids 47*a* is disposed downwardly, and at a lower end portion thereof, a bearing portion 47*c* is provided.

A left side of the shaft 31*a* of the upper-side roller 31 is rotatably inserted into the left-side bearing portion 47*c*, and the right side of the shaft 31*a* is rotatably inserted into the right-side bearing portion 47*c*. Further, with each of the left-and-right plungers 47*b*, a coil spring 47*d* as an urging member 47*d* is externally engaged, so that the coil spring 47*d* is compressed provided between the solenoid 47*a* and the bearing portion 47*c*. Energization to the left-and-right solenoids 47*a* is ON-OFF controlled by the CPU 13.

When the energization to the left-and-right solenoids 47*a* is turned off, by bridging forces of the springs 47*d*, the left-and-right plungers 47*b* are pressed down until the roller 31 is abutted against and received by the roller 32. By this, the upper-side roller 31 is held in a contact state in which the upper-side roller 31 is contacted to the lower-side roller 32 with a predetermined urging force by the bridging force of the spring 47*d*, so that a nip N3 for sandwiching and feeding the sheet P is formed between the rollers 31, 32.

Figure 5:
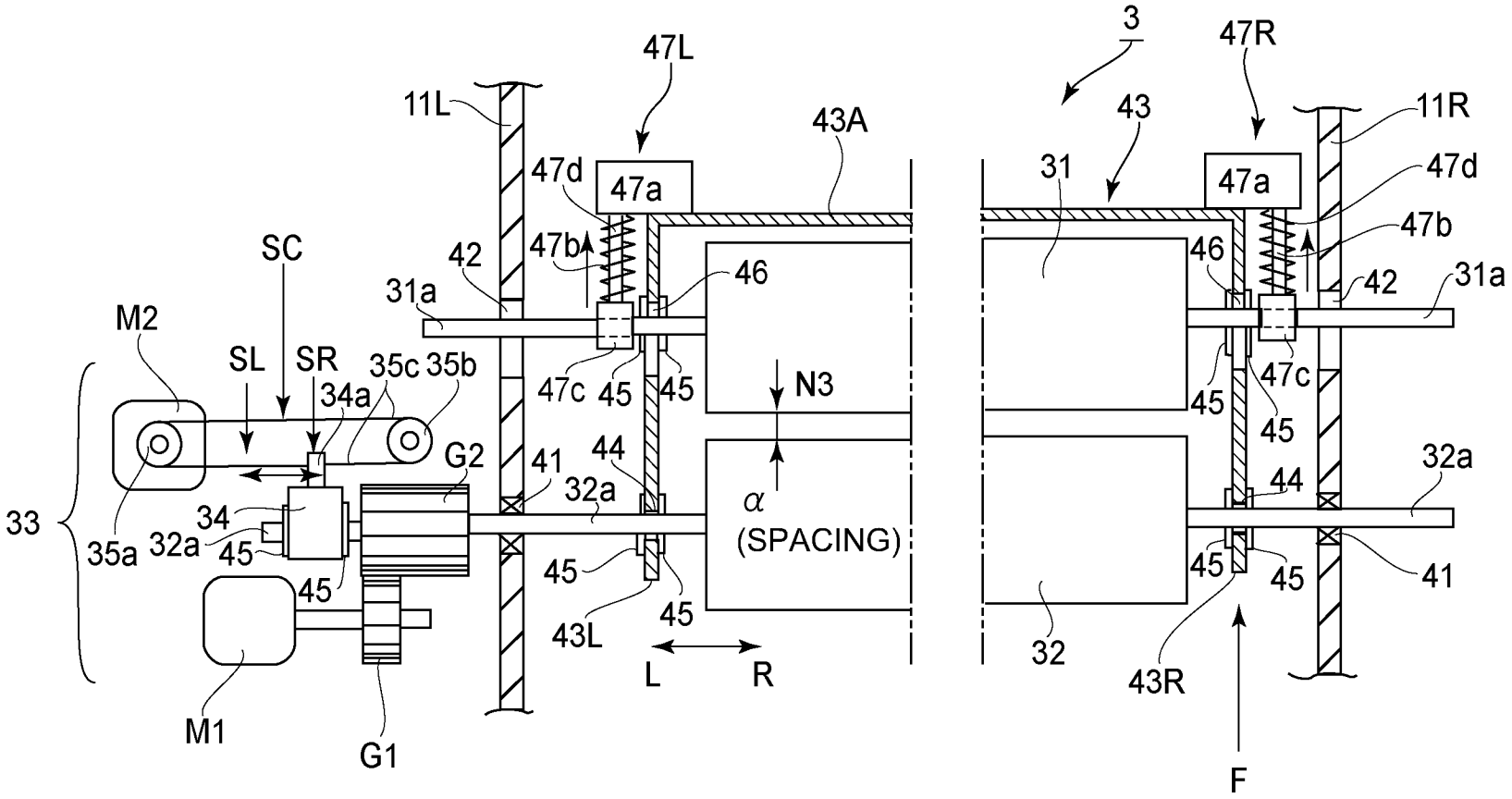
FIG. 5 is an illustration of the sheet shifting mechanism.

On the other hand, when the energization to the left-and-right solenoids 47*a* is turned on, by magnetic forces of the solenoids 47*a*, the left-and-right plungers 47*b* are pulled up against the bridging forces of the springs 47*d*, respectively. By this, the upper-side roller 31 is pulled up and moved from the lower-side roller 32 by a predetermined amount and is held in a spaced state in which the roller 31 is spaced from the roller 32 by a as shown in FIG. 5. That is, the roller 31 is held in a state in which the nip N3 between the rollers 31 and 32 is eliminated.

In one end side of the lower-side roller 32, a driving portion 33 having a function of rotationally driving this roller 32 and a shifting function of moving the rollers 31, 32 in the sheet widthwise direction which is a perpendicular direction to the sheet feeding direction B is provided.

In this embodiment, the driving portion 33 is disposed in the left-side apparatus frame plate 11L side. That is, a left-side end portion of the shaft 32*a* of the roller 32 projects from the bearing member 41 to an outside of the apparatus frame plate 11L. To the projecting shaft portion, a broad gear G2 is fixedly provided. With this gear G2, a gear G1 in a first motor (shifting roller motor: stepping motor) M1 side is engaged. The motor M1 is fixedly provided to the apparatus frame (not shown).

Drive of the motor M1 is ON-OFF controlled by the CPU 13. The motor M1 is driven in a predetermined rotational direction, so that a rotational force is driven to the shaft 32*a* by the gears G1, G2. By this, the lower-side roller 32 is rotationally driven in the sheet feeding direction. When the upper-side roller 31 contacts the lower-side roller 32, the roller 31 is rotated by rotation of the roller 32. That is, the motor M1 is driven, so that the rollers 31, 32 perform a rotation operation for feeding the sheet P in the feeding direction B. The upper-side roller 31 does not rotate when the roller 31 is spaced from the lower-side roller 32 (FIG. 5).

Further, at the left-side end portion of the shaft 32*a*, a bearing member 34 is provided, outside the gear G2, on the shaft 32*a* by a stopper ring 45 while being prevented from moving in a thrust direction. Further, to the apparatus frame (not shown), a second motor (shifting motor: stepping motor) M2 and a belt pulley 35*b* are provided. Between the pulley 35*b* and a driving pulley 35*a* provided on a shaft of the motor 2, a belt (timing belt) 35*c* is extended and stretched. Further, the bearing member 34 is connected with a lower-side belt portion of the belt 35*c* via a connecting portion 34*a*.

As shown in FIG. 3, in the case where the connecting portion 34*a* is positioned at a position SL toward an L side, the frame 43 including the rollers 31, 32 shifts and moves toward the left-side apparatus frame plate 11L side between the left-and-right apparatus frame plates 11L, 11R. That is, the frame 43 is positioned at an left-side shift position E.

Figure 4:
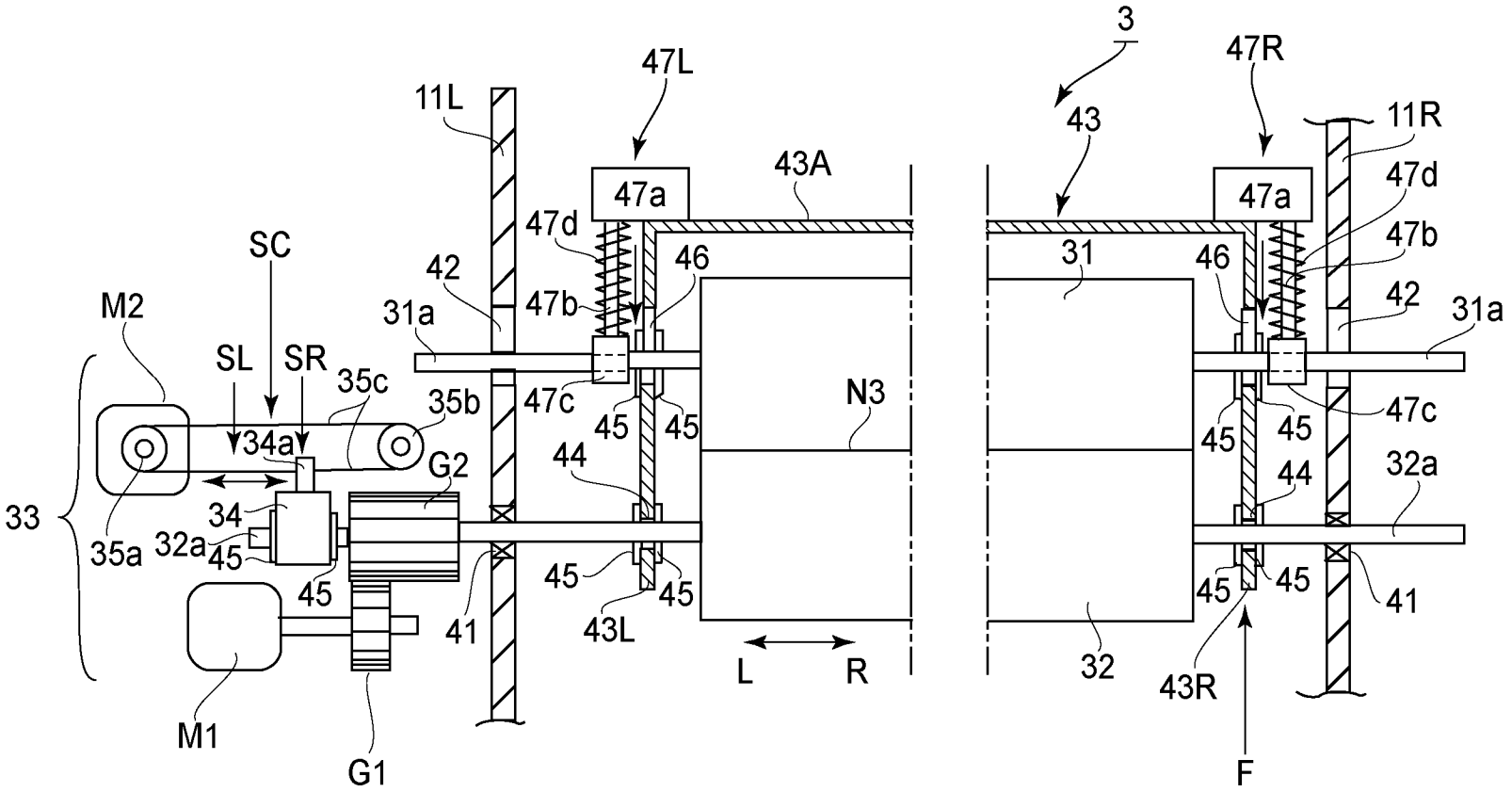
FIG. 4 is an illustration of the sheet shifting mechanism.

On the other hand, as shown in FIG. 4, in the case where the connecting portion 34*a* is positioned at a position SR toward an R side, the frame 43 including the rollers 31, 32 shifts and moves toward the right-side apparatus frame plate 11R side between the left-and-right apparatus frame plates 11L, 11R. That is, the frame 43 is positioned at an right-side shift position F.

The motor M2 is controlled by the CPU 13 via the shift amount controller 12. That is, control in which the motor M2 is normally rotated and driven by a predetermined control pulse number and control in which the motor M2 is reversely rotated and driven by the same pulse number are effected. At the time when normal rotation drive of the motor M2 is started, the connecting portion 34*a* locates, as a home position, an intermediary position SC between the position SL (FIG. 3) and the position SR (FIG. 4).

In this state, when the motor M2 is normally rotated and driven by the predetermined control pulse number, the belt 35*c* is rotationally moved in the counterclockwise direction, so that the connecting portion 34*a* moves from the home position SC in an right-side direction by a predetermined control amount. Then, the connecting portion 34*a* moves to and stops at a predetermined right-side end position SR. By this, the shaft 32*a* is slid and moved in the right direction, so that the frame 43 including the rollers 31, 32 moves, between the left-and-right apparatus frame plates 11L, 11R, in the right direction R of the right-side shift position F by the predetermined control amount as shown in FIG. 4.

Then, when the frame 43 shifts and moves toward the right-side apparatus frame plate 11R side in the direction R by the predetermined control amount as shown in FIG. 4, the motor M2 is reversely rotated and driven by the same predetermined pulse number as that during the normal rotation drive. By this, the connecting portion 34*a* is returned and moved from the predetermined right-side end position SR to the predetermined home position SC. With this movement, the frame 43 is returned and moved to the original position.

Further, in a state in which the connecting portion 34*a* locates at the home position SC, when the motor M2 is reversely rotated and driven by the predetermined control pulse number, the belt 35*c* is rotationally moved in the clockwise direction, so that the connecting portion 34*a* moves from the home position SC in an left direction by a predetermined control amount. Then, the connecting portion 34*a* moves to and stops at a predetermined left-side end position SL. By this, the shaft 32*a* is slid and moved in the right direction, so that the frame 43 moves, between the left-and-right apparatus frame plates 11L, 11R, in the left direction L of the left-side shift position L by the predetermined control amount as shown in FIG. 3.

Then, when the frame 43 shifts and moves toward the left-side apparatus frame plate 11L side in the direction R by the predetermined control amount as shown in FIG. 3, the motor M2 is normally rotated and driven by the same predetermined pulse number as that during the reverse rotation drive. By this, the connecting portion 34*a* is returned and moved from the predetermined left-side end position SL to the predetermined home position SC. With this movement, the frame 43 is returned and moved to the original position.

As described above, the motor M2 is normally rotated and driven by the predetermined control pulse number and is reversely rotated and driven by the same pulse number. By this, the rollers 31, 32 perform a reciprocal movement operation (shift) in sheet widthwise directions R, L perpendicular to the feeding direction B of the sheet P in the sheet feeding path plane.

In the sheet shifting mechanism 3 of the apparatus 1, a movable amount of the sheet P between the left-side shift position E and the right-side shift position F is 6 mm (3 mm in each side relative to the center position). This one-side movement amount of 3 mm was set so as to be larger than 2 mm which is each of left-and-right minimum margin widths of the sheet P with respect to the sheet widthwise direction during the image formation. By doing so, a cleaning effect during execution of the cleaning mode (cleanup mode) of the fixing roller 60 described later can be further achieved.

The CPU 13 carries out the following control about the shifting mechanism 3. During the normal state, the connecting portion 34*a* is positioned at the home position SC. In this state, the energization to the solenoid 37*a* is controlled so as to be off. By this, the upper-side roller 31 is in the contact state in which the upper-side roller 31 contacts the lower-side roller 32.

The CPU 13 turns on the motor M1 on the basis of a feeding start signal of the sheet P. By this, the rollers 31, 32 are rotationally driven in the sheet feeding direction. In this state, the leading end portion of the sheet P fed from the obliquely feeding mechanism 2 side along the regulating surface 21*a* of the plate 21 reaches the nip N3 between the rollers 31, 32 and is sandwiched between the rollers 31, 32. The CPU 13 detects in the following manner that the leading end portion of the sheet P reaches the nip N3 between the rollers 31, 32 and is sandwiched between the rollers 31, 32.

That is, detection is made by calculation (computation) from the time of a sheet feeding start from the sheet feeding mechanism 7, a feeding speed of the sheet P, and a feeding path length of the sheet P from the sheet feeding mechanism 7 to the nip N3. Or, detection is made by a sheet sensor (not shown) provided in a sheet exit side of the nip N3 between the rollers 31, 32. The CPU 13 causes the roller pair of the obliquely feeding roller 22 in the obliquely feeding mechanism 2 from each other on the basis of the detection signal. By this, sandwiching of the sheet P by the obliquely feeding rollers 22 is eliminated.

Further, the CPU 13 rotationally drives the second motor M2 of the shifting mechanism 3 by the predetermined control pulse number on the basis of the above-described detection signal. Then, the frame 43 including the rollers 31, 32 moves in the left direction F toward the left-side shift position E (FIG. 3) or in the right direction R toward the right-side shift position F (FIG. 4). That is, the sheet P sandwiched between the rollers 31, 32 is moved (shifted) in the left direction F or the right direction R with respect to the sheet widthwise direction perpendicular to the sheet feeding direction B while being fed in the B direction.

Thus, by changing the control pulse number by which the second motor M2 is normally rotated and driven, it is possible to change the feeding position of the sheet P with respect to the longitudinal direction (widthwise direction) of the transfer nip T.

Then, at timing when the leading end portion of the sheet P sandwiched between the rollers 31, 32 and fed in the B direction reaches the transfer nip T, the CPU 13 turns on the energization to the left-and-right solenoids 47*a*. By this, the roller 31 is pulled up from the roller 32 and in the spaced state (FIG. 5). That is, the sandwiching of the sheet P by the rollers 31, 32 is eliminated. The sheet P is sandwiched at the transfer nip T and is subsequently fed.

The CPU 13 detects, for example in the following manner, that the leading end portion of the sheet P reaches the transfer nip T and is sandwiched at the transfer nip T. That is, detection is made by calculation from the time when the leading end portion of the sheet P reaches the nip N3 and is sandwiched at the nip N3, a sheet feeding speed by the rollers 31, 32 and a sheet feeding path length between the nip N3 and the transfer nip T. Or, detection is made by a sheet sensor (not shown) provided in the sheet exit side of the transfer nip T.

When a trailing end portion of the sheet P fed by the transfer nip T passed through the position of the roller pair, of the rollers 22 of the obliquely feeding mechanism 2, being in the spaced state is detected by the calculation or the sheet sensor (not shown), the CPU 13 causes the roller pair to be returned from the spaced state to the contact state.

Further, when the trailing end portion of the sheet P passed through between the rollers 31, 32 being in the spaced state is detected by the calculation or the sheet sensor (not shown), the CPU 13 turns off the energization to the left-and-right solenoids 47*a*. By this, the rollers 31, 32 are returned from the spaced state to the contact state. The sheet shifting mechanism waits in this state for arrival of a subsequent sheet P from the obliquely feeding mechanism 2 side.

(1-4) Fixing Device 6

Figure 6:
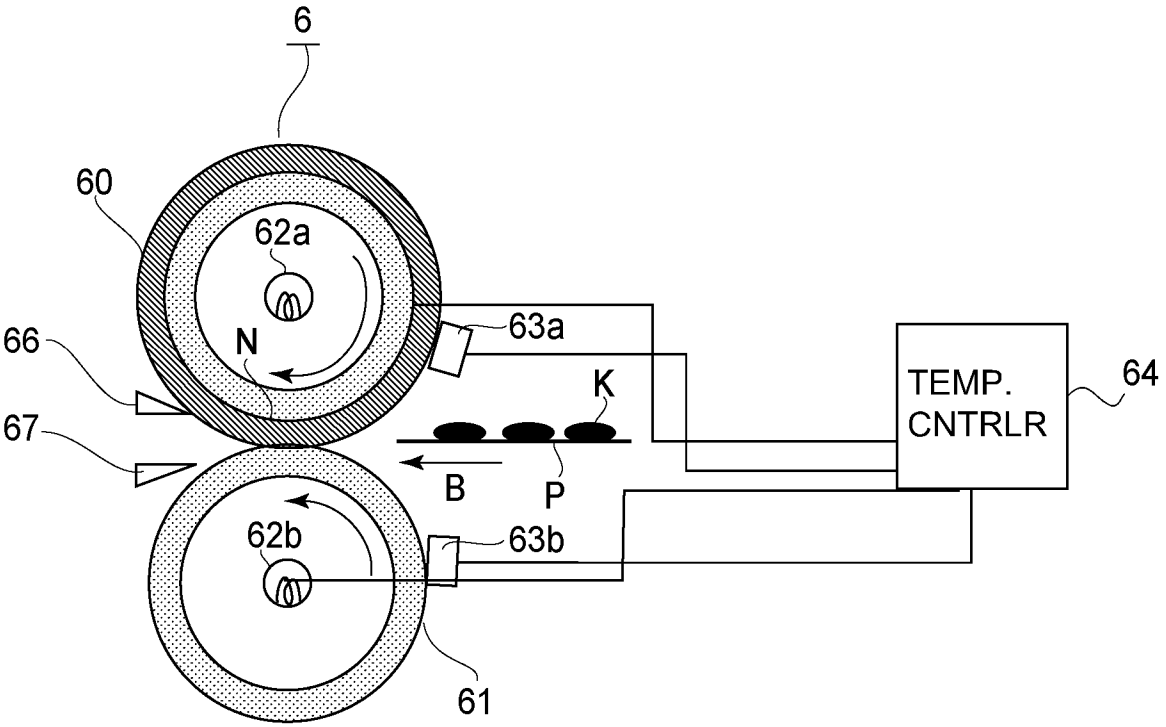
FIG. 6 is an illustration of a fixing device.

FIG. 6 is an illustration of a structure of the fixing device 6 relating to this embodiment. This fixing device 6 includes two parallel heating roller (hereinafter referred to as a fixing roller) 60 and pressing roller 61 as a rotatable heating member and a rotatable pressing member which form a nip N for fixing an unfixed toner image K formed on the sheet P by the image forming portion 5. Inside each of the fixing roller 60 and the pressing roller 61, halogen heaters 62*a*, 62*b* are provided, respectively. Further, the fixing device 6 includes separation claws 66, 67 and the like for preventing winding of the sheet P, around the fixing roller 60, after passing through the nip.

This fixing device 6 is of a heating roller type in which the sheet P electrostatically carrying the unfixed toner image K thereon is sandwiched and fed at the nip N which is a press-contact portion between the fixing roller 60 and the pressing roller 61 which rotate in arrow directions and the toner image K is fixed (melt-fixed) by heat and pressure. The press-contact between the fixing roller 60 and the pressing roller 61 may have any of constitutions including a constitution in which the pressing roller 61 is pressed against the fixing roller 60, a constitution in which the fixing roller 60 is pressed against the pressing roller 61, and a constitution in which both of the fixing roller 60 and the pressing roller 61 are pressed against each other.

The fixing roller 60 is 50 mm in outer diameter and includes an Si rubber layer of about 12 mm (in thickness) as an intermediary layer on a hollow Al core metal of 12 mm in thickness, and a surface layer is formed by coating, on the Si rubber layer, a fluorine-containing resin material, such as PTFE, of about 20 μm (in thickness). The pressing roller 61 is 50 mm in outer diameter, and on a hollow Al core metal of 12 mm in thickness, a silicone rubber layer of 25 μm (in thickness) and a parting layer of a PFA tube of about 50 μm (in thickness) are formed in this (named) order.

The fixing roller 60 and the pressing roller 61 are capable of being press-contacted to and spaced from each other, and are each driven by an unshown driving motor. The halogen heaters 62*a*, 62*b* heat inside surfaces of the fixing roller 60 and the pressing roller 61 with infrared radiation. 63*a*, 63*b* are temperature detecting elements such as a thermistor, a thermopile and the like. On the basis of output signals of the temperature detecting elements 63*a*, 63*b*, surface temperatures of the fixing roller 60 and the pressing roller 61 are detected, and the halogen heaters 62*a*, 62*b* are controlled through the temperature control device 64. In this embodiment, during the image formation, control is carried out so as to maintain the fixing roller 60 at 160° C. and the pressing roller 61 at 100° C.

The sheet P carrying the unfixed toner image K thereon is inserted into the fixing nip N which is a press-contact portion between the fixing roller (fixing member) 60 and the pressing roller (pressing member) 61 and is sandwiched and fed through the fixing nip N. Then, the unfixed toner image K is fixed as a fixed image on the sheet P by heat and nip pressure at the fixing nip N.

(1-5) Cleaning Mode (Cleanup Mode)

In this embodiment, a cleaning sheet for cleaning the fixing roller 60 of the fixing device 6 is introduced by using the sheet shifting mechanism 3 provided in a side upstream of the transfer nip T with respect to the sheet feeding direction. That is, in this embodiment, when the sheet is inserted into the nip N in (an operation in) a cleaning mode, the sheet shifting mechanism 3 is used as a changing mechanism for changing a relative position of the sheet for cleaning relative to the fixing roller 60 with respect to the widthwise direction of the fixing roller 60.

Figure 7:
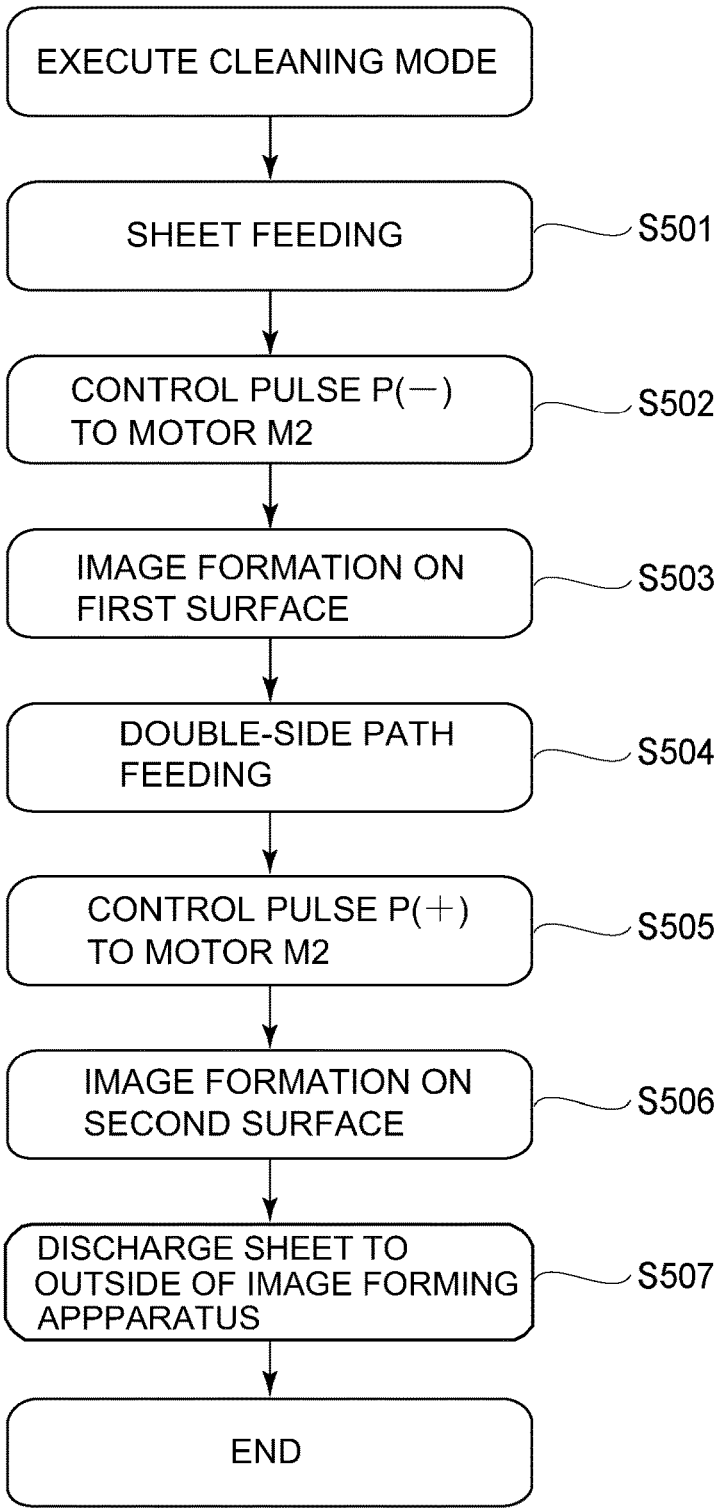
FIG. 7 is a sequence diagram relating to a cleaning mode in Embodiment 1.

FIG. 7 shows an execution flowchart of the cleaning mode of the fixing roller 60 in this embodiment. An execution instruction 300*a* of this mode is inputted into the CPU 13 by an execution key 200*a* on an operating portion 200 or a host device 300 such as an externally connected PC. The execution key 200*a* is a manual inputting means by which a user can arbitrarily input the execution instruction of the cleaning mode into the CPU 13.

Then, the CPU 13 operates the sheet feeding mechanism 7, so that a single sheet P is fed to the image forming portion 5 (S501). As in this apparatus 1, in the case where there are a plurality of cassettes, as a sheet accommodating portion, as shown by 7*a* and 7*b*, feeding of the sheet can be performed in the following manner. That is, the user may be capable of selecting the cassette in advance of feeding of the sheet P during the execution of the cleaning mode or may also be capable of automatically selecting the sheet feeding cassette on the basis of procedure. In this embodiment, the sheet which is usable in the apparatus and which has a maximum width is fed.

Then, when the sheet P reaches the shifting mechanism 3, the CPU 13 inputs a predetermined control pulse P(−) into the motor M2 and controls the shifting mechanism 3 so that the sheet P is shifted by 3 mm form a widthwise center toward the left side (L direction in FIG. 3) with respect to the widthwise direction (S502). Then, a whole-surface solid black image (predetermined image for cleaning) is formed on first side (surface) of this sheet P by the image forming portion 5, so that the sheet for cleaning (hereinafter referred to as a cleaning sheet) Pc is prepared (S503).

At this time, image formation is effected so that left-and-right margin widths of this cleaning sheet Pc with respect to the widthwise direction are minimum, i.e., 2 mm in each of left-and-right sides in the apparatus 1. That is, as regards the image for cleaning, the toner image is formed over an entire region, of the sheet P with respect to the widthwise direction, in which the image is formable. Incidentally, as regards leading and trailing end margins of the cleaning sheet Pc with respect to the feeding direction, these margins have no influence on the cleaning effect and therefore may be an arbitrary value, but were set at 10 mm in the mode of this embodiment.

Thus, the cleaning sheet Pc on which the solid black image is formed on the first side passes through the fixing device 6 in a state in which the cleaning sheet Pc is shifted toward the left side by 3 mm. By this, of contaminations deposited on the fixing roller surface at left-and-right end portions during the image formation, the left-side contamination contacts an image portion of the cleaning sheet Pc and is removed by being transferred on the cleaning sheet Pc side by a bonding force between toners (toner particles).

The CPU 13 introduces the cleaning sheet Pc, passed through the fixing device 6, into the double-side feeding path (double-side path portion) 11. By this, the cleaning sheet Pc is turned upside down and is fed so that the image is formed on a second side (surface) (S504). This image formation on the second side of the cleaning sheet Pc is effected by controlling a feeding position of the cleaning sheet Pc relative to the transfer nip T in the following manner.

That is, the CPU 13 inputs a predetermined control pulse P(+) into the motor M2 and controls the shifting mechanism 3 so that the cleaning sheet Pc is shifted by 3 mm in an opposite direction to that for the first side, i.e., toward the right side (R direction in FIG. 3) from the widthwise center by the shifting mechanism 3 (S505). Then, similarly as in the first side, the solid black image is formed by the image forming portion 5 (S506). This cleaning sheet Pc passes through the fixing device 6, so that at this time, the contamination on the fixing roller at the right-side end portion is removed (cleaned). Then, the cleaning sheet Pc passed through the fixing device 6 is discharged to the outside of the apparatus 1 (S507), so that the cleaning mode is ended.

Figure 9:
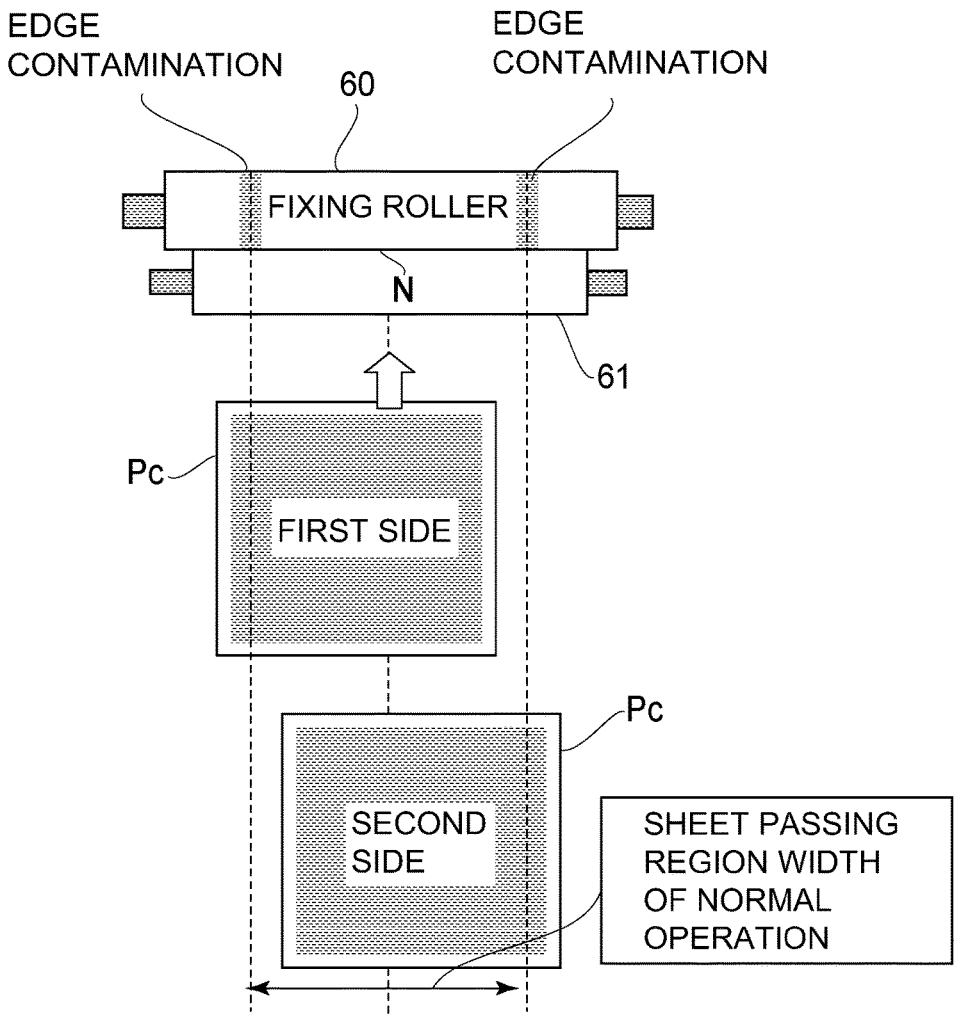
FIG. 9 is an illustration (double-side (printing) one sheet) relating to a feeding position of a cleaning sheet in Embodiment 1.

In this embodiment, as shown in FIG. 9, the cleaning sheet Pc is passed two times through the fixing nip T by feeding both sides (surfaces) of the singe cleaning sheet Pc.

A cleaning execution constitution of the fixing device 6 described above in this Embodiment 1 is summarized as follows.

The executing portion 13 for executing the cleaning mode in which the cleaning sheet Pc on which the predetermined image is formed by the image forming portion 5 is inserted and passed through the nip N and in which the cleaning sheet Pc cleans the fixing roller 60 is provided. Further, the changing mechanism 3 for changing relative positions of the first side and the second side of the sheet relative to the fixing roller 60 with respect to the widthwise direction of the fixing roller 60 when the sheet is inserted and passed at least two times through the nip N in the cleanup mode is provided. A change amount of the relative position is larger than a minimum margin width, in one end side and the other end side with respect to the widthwise direction, of the sheet selectable during the image formation.

The sheet for the first side and the second side is the same (single) sheet, and the second-side sheet is a sheet such that the first-side sheet on which the predetermined image is formed on the first side and which passed through the nip N is turned upside down, and then is subjected to double-side feeding to the image forming portion 5, and thus the predetermined image is formed on the second side.

Figure 10:
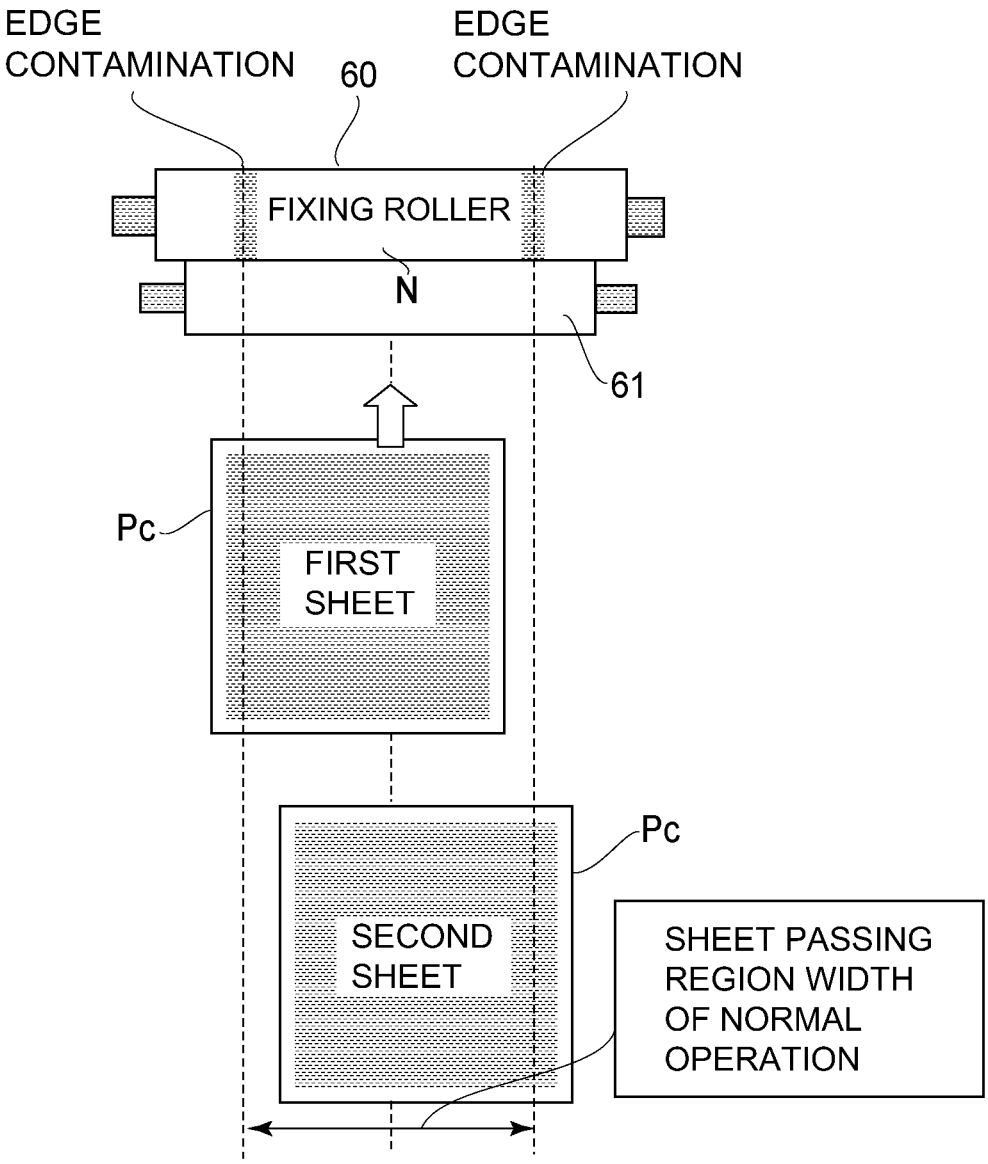
FIG. 10 is an illustration (one-side (printing) two sheets) relating to a cleaning position of a cleaning sheet in Embodiment 1.

In a small-sized image forming apparatus or the like in which there is no double-side feeding path (double-side path portion) 11, a similar effect can be obtained even when a control system in which two cleaning sheets Pc are successively subjected to one-side feeding as shown in FIG. 10. That is, in the above, the first-side sheet and the second-side sheet are separate two sheets.

Further, in order to alleviate the abrasion of the fixing roller surface due to burrs at the widthwise end portions of the sheet P, in the case where the relative position of the sheet P to the fixing roller 60 with respect to the widthwise direction during passing of the sheet P through the fixing nip is shifted every sheet by controlling the shifting mechanism 3, the following control may be carried out.

As regards the control pulse number of the motor M2, a control pulse number P during the image formation is used in a range of Pmin-Pmax. On the other hand, control pulse numbers P(−), P(+) used during the cleaning mode are set so as to provide relationships of P(−)<Pmin, P(+)>Pmax.

By this, outside the region through which the sheet P passes during the image formation, the cleaning sheet pc can be passed, so that the unfixed toner image on the cleaning Pc can contact toner contamination with reliability and thus it is possible to remove the toner contamination.

<Embodiment2>

In this embodiment, in an image forming apparatus including a fixing device 6 of a belt type, similarly as Embodiment 1, a sheet Pc for cleaning is fed using the sheet shifting mechanism 3 provided upstream of the transfer nip T.

In this embodiment, the feeding position (passing position) of the cleaning sheet Pc relative to the transfer nip T is controlled in consideration of shift control of a heating belt (hereinafter referred to as a fixing belt) as a rotatable heating member in the fixing device 6 of the belt type. That is, a positional change of the fixing belt with belt shift control is taken into consideration, and the feeding position is controlled. For that reason, compared with the case where the frame does not move in the longitudinal direction as in Embodiment 1, there is a need to largely change first-side and second-side feeding positions of the cleaning sheet Pc during the passing of the cleaning sheet Pc through the fixing nip.

(2-1)

FIG. 11A-E are structural illustrations of the fixing device 6 in this embodiment. In this embodiment, the fixing device 6 is a fixing device of an induction heating belt type. The sheet P carrying the unfixed toner image K thereon is introduced into a nip N6 which is a press-contact portion between the fixing belt 130 as the rotatable heating member heated at about 200° C. in the fixing device 6 and a pressing belt 120 as a rotatable pressing member and is sandwiched and fed through the nip N6. Then, the unfixed toner image K is fixed as a fixed image on the sheet P by heat and nip pressure at the nip N6. The sheet P on which the image is fixed is discharged to the outside of the apparatus.

Figure 11A:
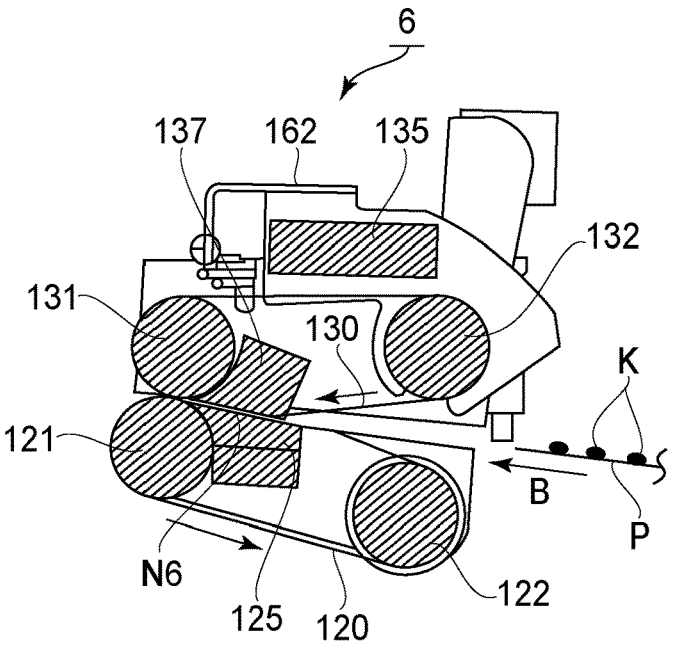
FIGS. 11A, 11B, 11C, 11D and 11E are illustrations of a fixing device in Embodiment 2.
Figure 11B:
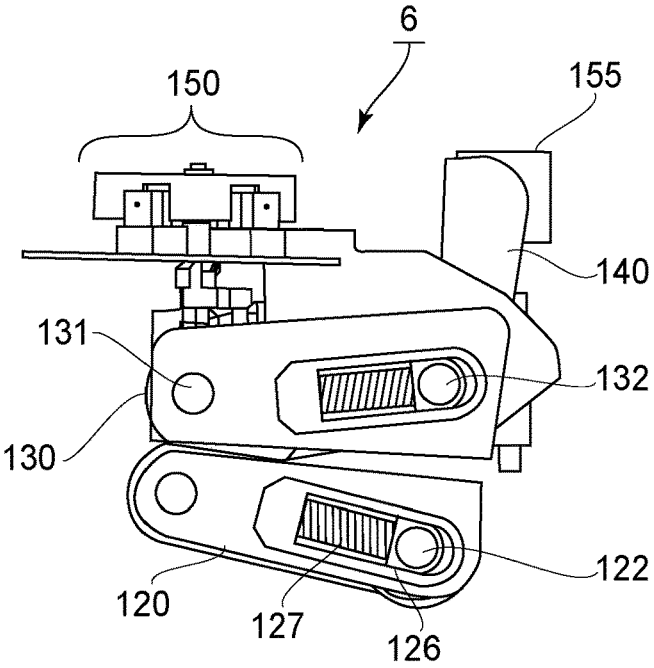
Figure 11C:
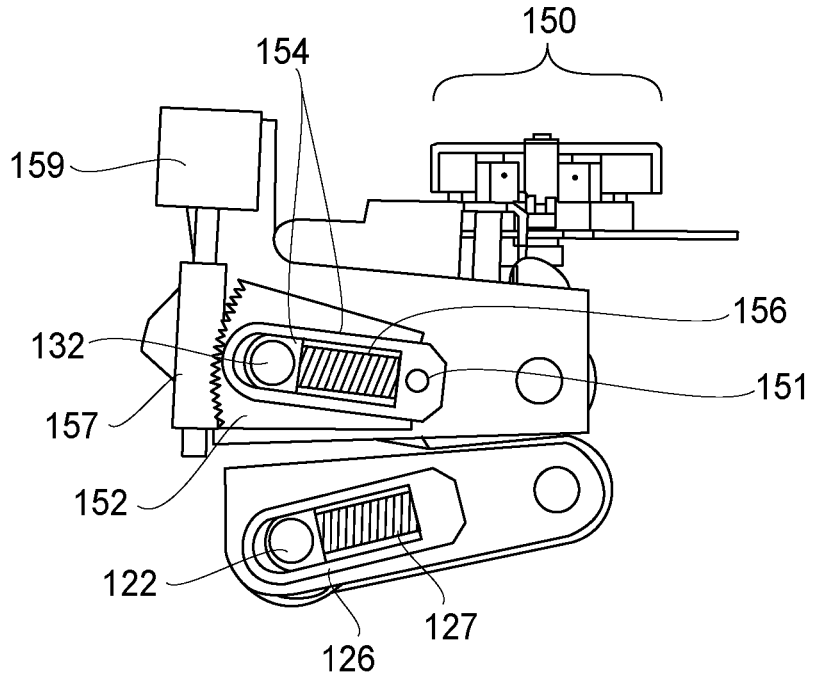
Figure 11D:
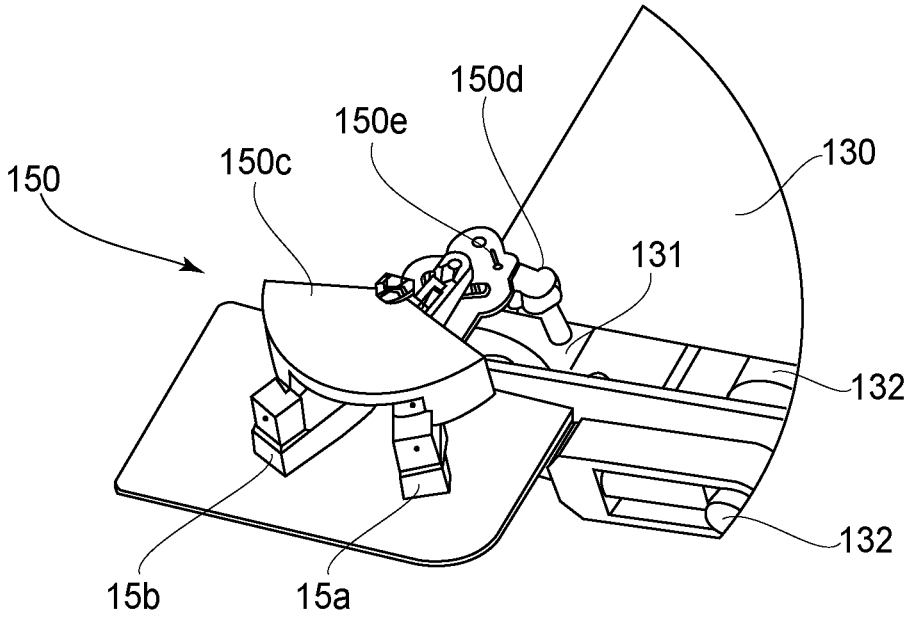

FIG. 11A is a cross-sectional view of the fixing device 6, FIG. 11B is a side view of a left side (one end side), and FIG. 11C is a side view of a right side (the other end side). The pressing belt 120 is extended around two supporting rollers, i.e., a pressing roller 121 and a tension roller 122 having a function of imparting belt tension to the belt so as to be capable of being circulated and rotated with predetermined tension (e.g., 200N). As the pressing belt 120, a pressing belt may appropriately selected when the pressing belt has a heat-resistant property. For example, a belt formed by coating a nickel metal layer of, e.g., 50 μm in thickness, 380 mm in width and 200 mm in circumferential length with a silicone rubber of, e.g., 300 μm in thickness and by coating the silicone rubber with a PFA tube as a surface layer is used.

The fixing belt 130 is extended around two supporting rollers, i.e., a driving roller 131 and a steering roller 132 having a function of imparting belt tension to the belt so as to be capable of being circulated and rotated with predetermined tension (e.g., 200N). As the fixing belt 130, a pressing belt may appropriately selected when the fixing belt is heated by an induction heating coil 135 and has a heat-resistant property. For example, one formed by coating a magnetic metal layer such as a nickel metal layer or a stainless layer of, e.g., 75 μm in thickness, 380 mm in width and 200 mm in circumferential length with a silicone rubber of, e.g., 300 μm in thickness and by coating the silicone rubber with a PFA tube as a surface layer is used.

A pad 125 is provided in an inside, of the pressing belt 120, corresponding to a sheet entrance side (side upstream of the pressing roller 121 with respect to the sheet feeding direction) in a fixing nip region which is a press-contact portion between the pressing belt 120 and the fixing belt 130. The pad 125 is formed with a silicone rubber, for example. The pad 125 is pressed against the pressing belt 120 with predetermined pressure (e.g., 400N), and forms the nip N6 together with the pressing roller 121.

The pressing roller 121 is, for example, a roller, formed of φ20 in outer diameter with a solid stainless steel, for stretching the pressing belt 120, and is provided in a sheet exit side of the fixing nip region between the pressing belt 120 and the fixing belt 130. Further, the tension roller 122 is, for example, a hollow roller, formed of φ20 in outer diameter and φ18 in inner diameter with a stainless steel, and acts as a belt stretching roller. Both end portions of the tension roller 122 are supported by bearing 126 as shown in FIGS. 11B and 11C, and tension of 20 kgf is applied to the belt 120 by tension springs 127.

A pad stay 137 is provided in an inside, of the fixing belt 130, corresponding to a sheet entrance side (side upstream of the driving roller 131 with respect to the sheet feeding direction) in a fixing nip region which is a press-contact portion between the fixing belt 130 and the pressing belt 120. The stay 137 is formed with a stainless steel (SUS material), for example. The stay 137 is pressed toward the pressing pad 125 with predetermined pressure (e.g., 400N), and forms the fixing nip N6 together with the driving roller 131.

The driving roller 131 is, for example, a roller, formed by integrally molding a heat-resistant silicone rubber elastic layer around a core metal surface layer formed of φ18 in outer diameter with a solid stainless steel. This roller 131 is provided in the sheet exit side of the fixing nip region between the fixing belt 130 and the pressing belt 120, and the elastic layer thereof is elastically distorted in a predetermined amount by the press-contact of the pressing roller 121.

Further, the steering roller 132 is, for example, a hollow roller formed of φ20 in outer diameter and about φ18 in inner diameter with a stainless steel. Further, the steering roller 132 not only functions as a steering roller for adjusting meandering of the fixing belt with respect to the widthwise direction perpendicular to the movement direction of the fixing belt 130 but also functions as a belt stretching roller.

By a motor (not shown) which is a driving source, drive is inputted from an external portion into the driving roller 131, so that the fixing belt 130 is fed by rotation of the driving roller 131. In order to stably feed the sheet P, the drive is transmitted between the fixing belt 130 and the driving roller 131 with reliability. In the neighborhood of an end portion of the fixing belt 130 in a fixing device left side, a sensor portion 150 for detecting a belt end portion position is provided. The end portion position of the fixing belt 130 is detected by the sensor portion 150, and depending thereon, an inclination of the steering roller 132 is changed, so that the shift control of the belt is carried out.

A steering roller supporting arm 154 is supported by a shaft 151, fixed in an outside of the side plate 140, so as to be rotatable about this shaft 151. This arm 154 is provided with a steering roller bearing 153 supporting the steering roller 132 rotatably and slidably in a belt tension direction. Further, the arm 154 is provided with a tension spring 156 for urging the bearing 153 in the belt tension direction to impart tension to the belt, so that tension of 20 kgf is applied to the fixing belt 130.

At a periphery of the arm 154, a sector gear 152 is fixed and is engaged with a worm 157 capable of being rotationally driven by drive of a stepping motor 159. The end portion position of the fixing belt 130 is detected by the sensor portion 150, and depending thereon, the stepping motor 159 is rotated by a predetermined number of rotations, so that the inclination of the steering roller 132 is changed, and thus the shift control of the belt is carried out.

The sensor portion 150 includes two sensors 150*a*, 150*b*, a sensor flag 150*c*, and a sensor arm 150*d*. Further, the sensor portion 150 includes a sensor spring 150*e* for operating the sensor arm 150*d* while following motion of the sensor arm 150*d* and the fixing belt 130, and the sensor arm 150*d* is pressed and contacted to an end surface of the fixing belt 130 with a force of 3 kgf. Further, by combinations of respective ON/OFF signals of the sensors 150*a*, 105*b*, position detection (belt shift detection) of the belt 130 with respect to the belt widthwise direction along axial directions of the rollers 131, 132 is carried out.

In the above, the steering roller 132, the arm 154, the sector gear 152, the worm 157, the stepping motor 159, and the like are a frame position control mechanism for moving the fixing belt 130 in the direction perpendicular to the sheet feeding direction B. Further, the sensor portion 150 is a frame position detecting means for detecting, as frame position information, a movement position of the fixing belt 130 in the direction perpendicular to the sheet feeding direction B.

Figures 11E, 12A:
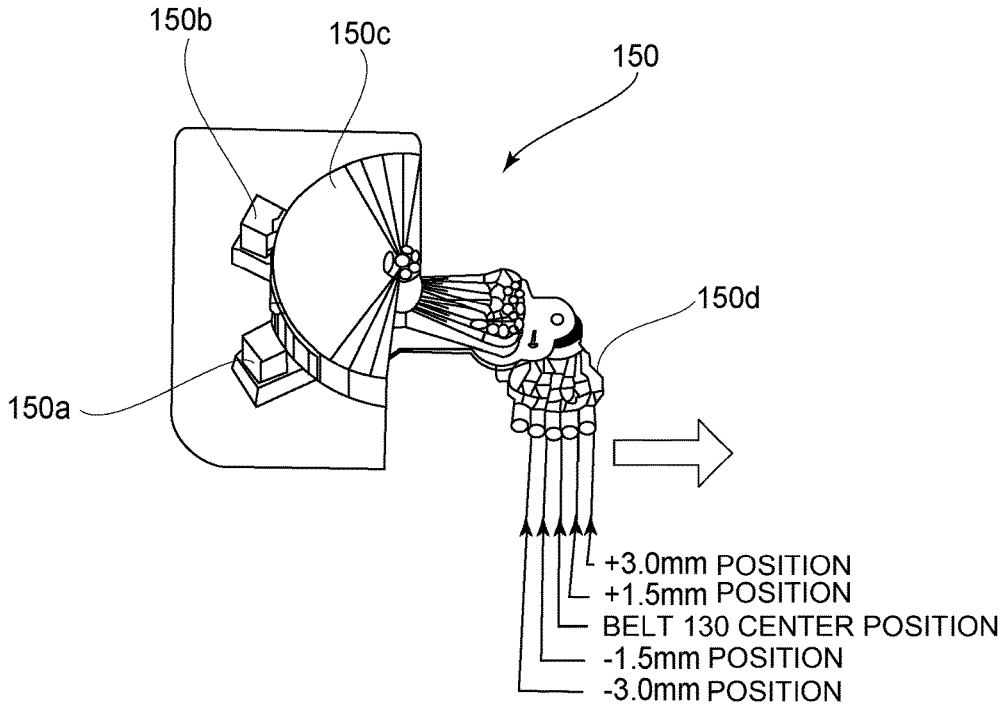
FIG. 12A is a table for illustrating a relationship between a fixing belt position and a sensor large.
Figure 12B:
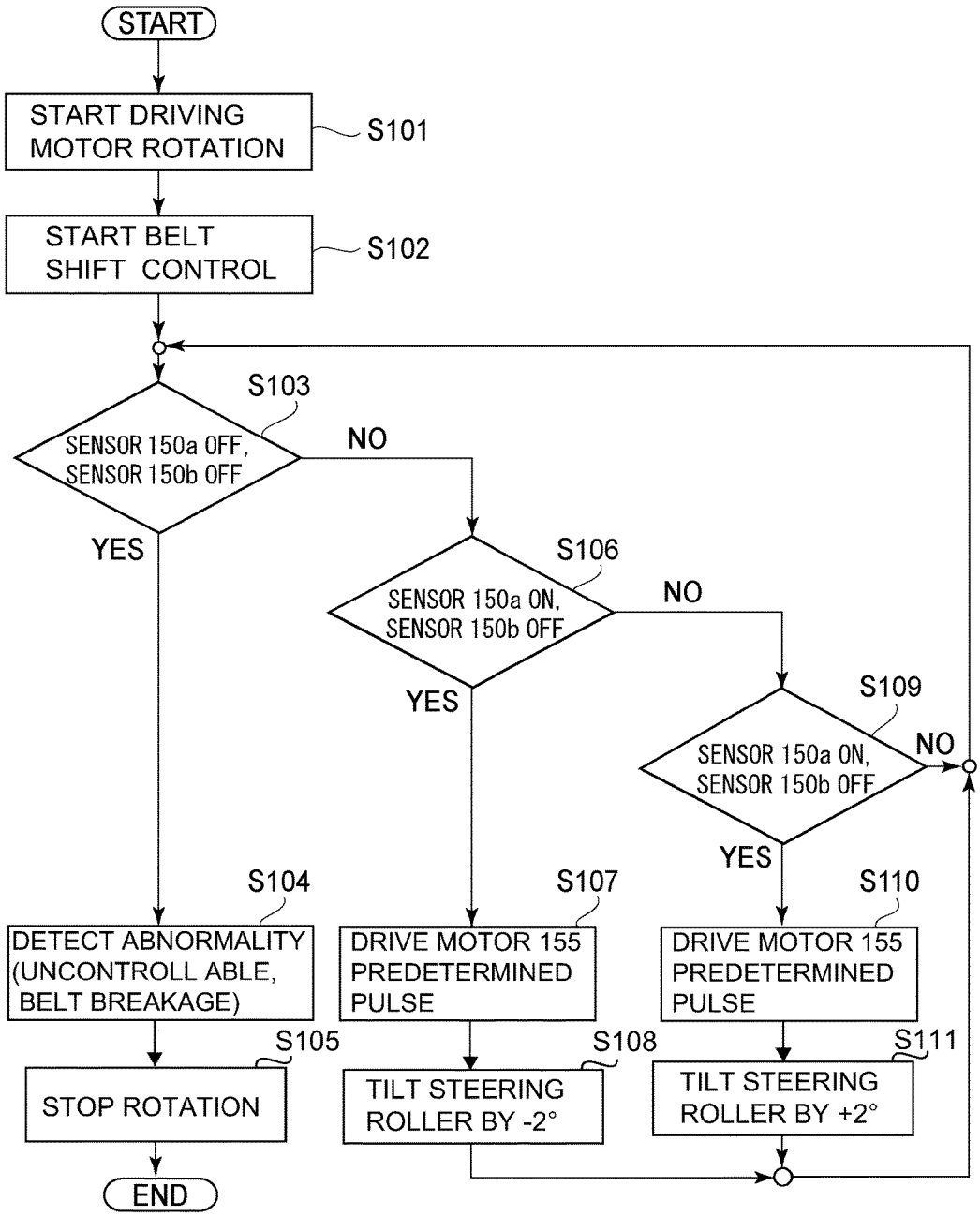
FIG. 12B is a flowchart for illustrating a fixing belt shift control.

A relationship between the combination of the ON/OFF signals of the sensors 150*a,b* and the end surface position of the fixing belt 130 at that time is shown in FIG. 12A, positions at that time are shown in FIG. 11E, and a shift control flowchart is shown in FIG. 12B. Incidentally, the signal is OFF when the respective sensors 150*a*, 150*b* are light-blocked by the flag, and an ON signal is outputted when light passes through the flag.

As shown in FIGS. 12A and 12B, the fixing belt 130 reciprocates between a position (step S106) where the sensor 150*a* is ON and the sensor 150*b* is OFF and a position (step S109) where the sensor 150*a* is OFF and the sensor 150*b* is ON. Further, the shift control is carried out so that the fixing belt 130 exists in that section.

A distance of that section is ±1.5 mm from a center position of the fixing belt 130 with respect to a rotational axis direction of the fixing belt 130. Based on position of the fixing belt 130 detected by the sensor portion 150 through the belt shift control, a predetermined driving pulse is outputted to the stepping motor 159 via a motor driver 160 (steps S107, S110). The steering roller 132 is driven by the motor 159 and is tilted relative to the driving roller 131 by ±2°, so that the control is carried out (S108, S111).

In a state in which the shift control is disabled, when the end (edge) surface of the fixing belt 130 reaches a position which is ±3 mm from the center position, both of the sensors 150*a*, 150 are OFF (step S03). At this time, the CPU 13 discriminates that abnormality generates (step S104), and stops heating of the fixing device 6 and rotation operation of the fixing belt (step S105).

(2-2) Cleaning Mode <Shift Amount in View of Shift Position of Fixing Member>

Also in the belt type fixing device 6 employed in this embodiment, as regards a flow when cleaning of the fixing belt is executed, the cleaning mode is executed on the basis of the flow of FIG. 7.

Figure 13:
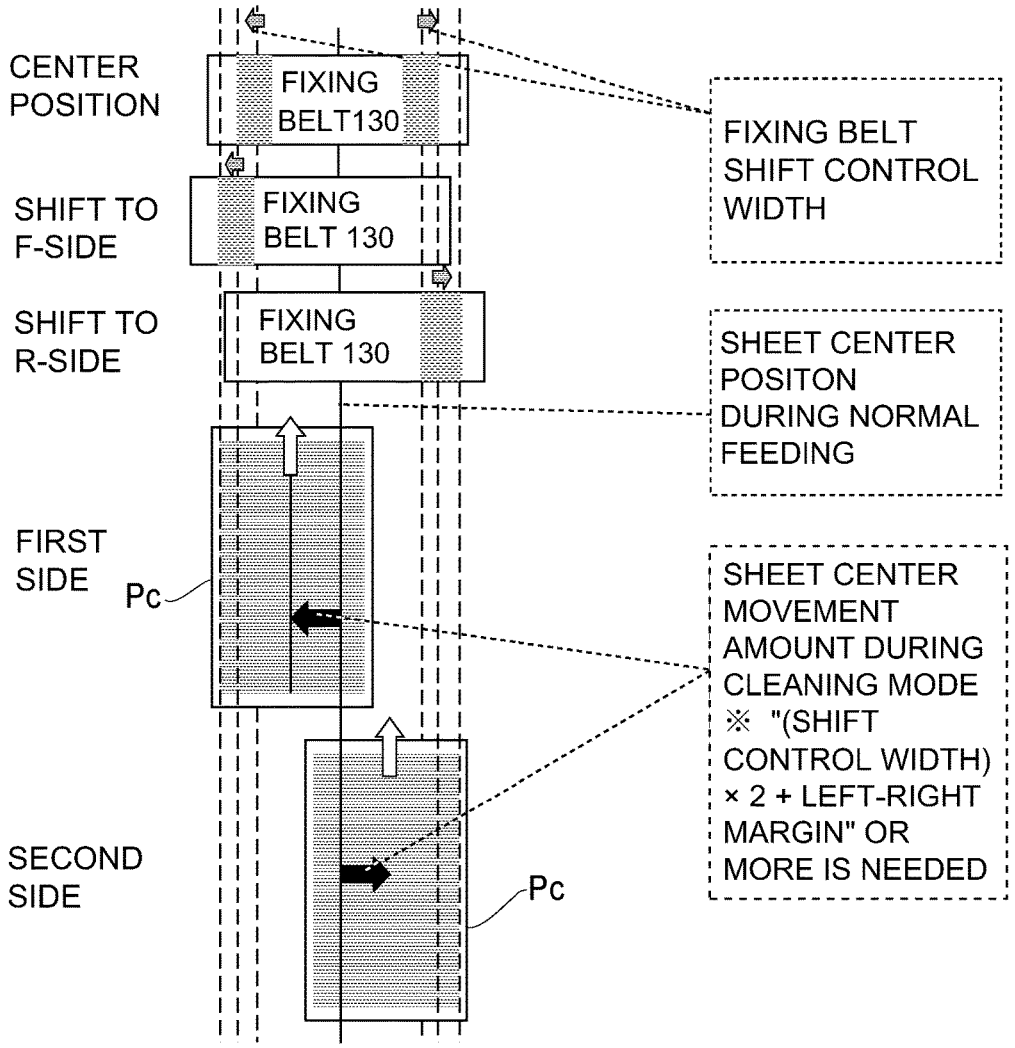
FIG. 13 is an illustration relating to a feeding position of a cleaning sheet in Embodiment 2.

However, a widthwise positional relationship (longitudinal positional relationship) between the fixing belt 130 subjected to the shift control as described above and the cleaning sheet Pc may preferably be taken into consideration with respect to a widthwise feeding position of the cleaning sheet Pc in order to obtain a cleaning effect as shown in FIG. 13. That is, in the case where the fixing belt 130 is shifted in the widthwise direction by the shift control, the cleaning effect by the cleaning sheet Pc is prevented from being lost by the shift. For that reason, there is a need that a one-side movement amount of the cleaning sheet Pc with respect to the widthwise direction is determined by taking a one-side movement amount and a one-side minimum margin of the fixing belt 130 into consideration.

In this embodiment, the one-side movement amount of the fixing belt 130 is 1.5 mm, and therefore toner contamination of 3 mm in width generates on the fixing belt surface. Further, the one-side minimum margin is 2 mm, and therefore the one-side movement amount of the cleaning sheet Pc was set at 5.5 mm so as to be not less than 5.0 mm. By doing so, in any state when the fixing belt 130 performs a reciprocal shift operation in the widthwise direction by the shift control, the widthwise position of the cleaning sheet Pc is shifted toward both ends by 5.5 mm and passes through the fixing belt 130. By this, the toner contamination on the fixing belt 130 can be removed (cleaned) with reliability.

Further, as another method, the widthwise position of the fixing belt 130 is discriminated by the CPU 13, and the cleaning sheet pc can be passed through the fixing belt 130 at timing when the cleaning effect is more achieved. That is, when the cleaning sheet Pc is shifted toward the left side with respect to the widthwise direction and is passed through the fixing nip N6, the control is effected so that the cleaning sheet Pc is passed through the fixing nip N6 at timing when the fixing belt 130 is positioned in the left surface with respect to the widthwise direction. On the other hand, when the cleaning sheet Pc is shifted toward the right side with respect to the widthwise direction and is passed through the fixing nip N6, the control is effected so that the cleaning sheet Pc is passed through the fixing nip N6 at timing when the fixing belt 130 is positioned in the right surface with respect to the widthwise direction.

By doing so, it is possible to more effectively remove the toner contamination deposited on the fixing belt 130, outside a normal feeding position.

Further, as further another method, a method in which the cleaning mode is executed by moving the fixing belt 130, by the shift control mechanism (shifting mechanism) for the fixing belt 130, so as to change only the widthwise position of the fixing belt 130 without changing the feeding position of the sheet P would be considered.

In this case, compared with at least a normal operation, movement widths of the fixing belt and the pressing belt are required to be increased. For that reason, the shift control mechanism is complicated. Further, there is a possibility that the fixing belt and the pressing belt are completely shifted (to an end) and are broken. Further, it takes time that the fixing belt and the pressing belt reciprocate between both ends with respect to the widthwise direction, and therefore a time required to carry out the cleaning becomes long. From this result, even in the fixing device of the belt type, feeding of the cleaning sheet Pc may preferably be controlled by the sheet shifting mechanism 3 as in this embodiment.

Further, in order to change a relative position between the rotatable heating member and the cleaning sheet Pc, as an alternative method for moving the rotatable heating member, a mechanism (shifting mechanism) for reciprocating the fixing device (rotatable heating member and rotatable pressing member) itself is provided. Further, there is also a method for feeding the cleaning sheet Pc in synchronism with the reciprocating operation. In this method, compared with the case where the cleaning sheet Pc is fed in synchronism with the shift control of the fixing belt 130, the fixing device 6 can be moved to a desired position and stopped at the position, so that a harmful influence thereon is small.

A cleaning execution constitution of the fixing device 6 described above is summarized as follows. The changing mechanism for changing relative positions of the first side and the second side of the sheet relative to the fixing belt 130 with respect to the widthwise direction of the fixing belt 130 when the sheet is inserted and passed at least two times through the nip in the cleanup mode is provided.

As the changing mechanism, both of the shifting mechanism and the sheet shifting mechanism 3 which are capable of moving the rotatable heating member or the rotatable pressing member in the widthwise direction as described above are provided. Further, a maximum movement amount of the sheet shifting mechanism 3 in the widthwise direction is larger than a maximum movement amount, with respect to the widthwise direction of the shifting mechanism for shifting the position of the fixing member.

<Embodiment3>

In Embodiments 1 and 2, the cleaning mode was described as the cleaning mode which can be arbitrarily executed when a user feels necessity of the cleaning of the rotatable heating member of the fixing device. On the other hand, a control constitution in which a control mode for automatically executing the cleaning mode is set in the image forming apparatus in advance or in which a recommendation message for prompting the user to execute the cleaning mode as needed is displayed on a screen portion 200*b* (FIG. 8) of the operating portion 200 may also be used.

Figure 14:
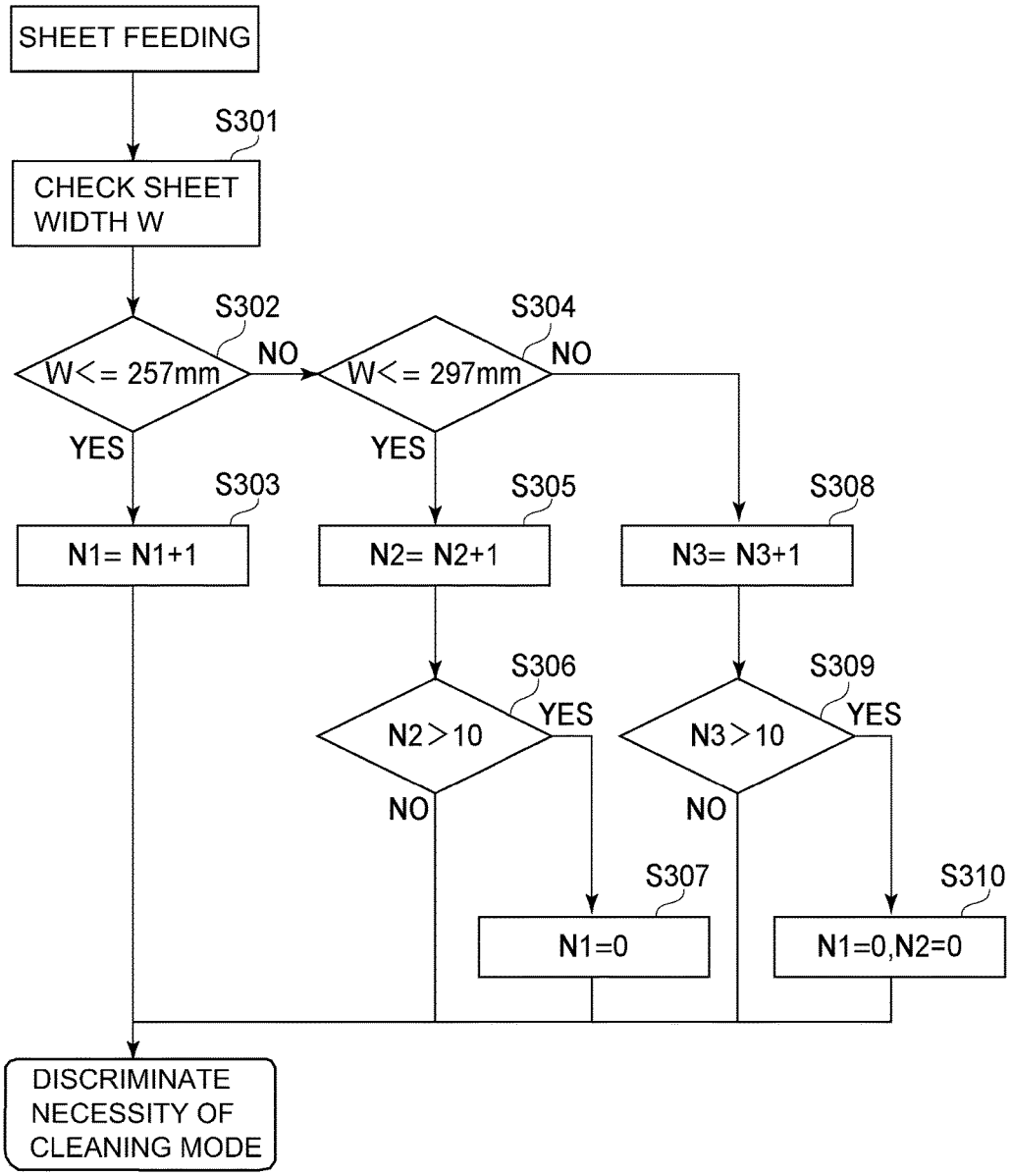
FIG. 14 is a sequence diagram relating to an integrating counter in Embodiment 3.
Figure 15:
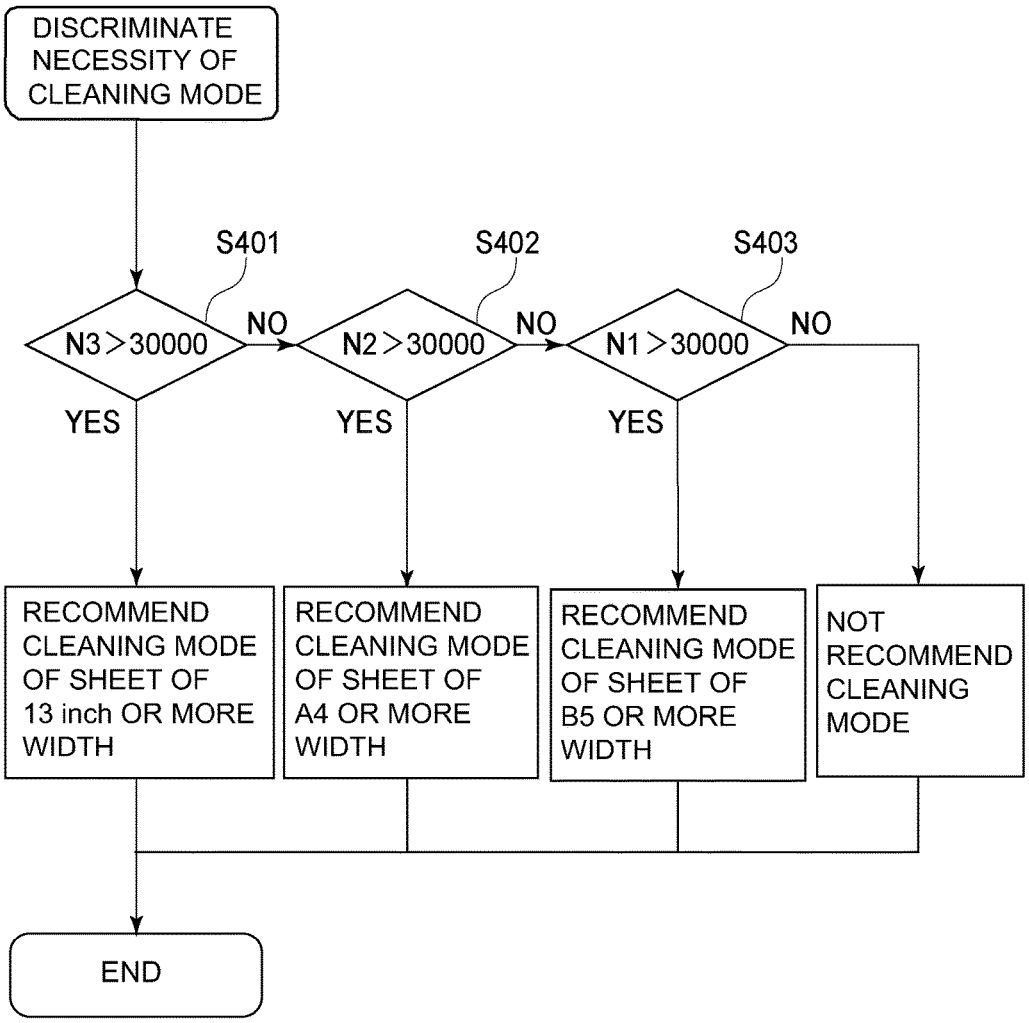
FIG. 15 is a sequence diagram relating to cleaning recommendation display in Embodiment 3.

In this Embodiment 3, a cleaning counter (discriminating means for discriminating a degree of contamination of the surface of the rotatable heating member) 16 (FIG. 8) will be described. FIG. 14 and FIG. 15 are sequence diagrams relating to the cleaning counter 16 in this Embodiment 3.

When the sheet P is fed by the sheet feeding mechanism 7 during normal printing, the CPU 13 checks a width size of the sheet P registered in advance (S301). Further, by steps S302, S304, a feeding counter grouped depending on the width size is read, and 1 is counted up per one feeding (S303, S305, S308).

Here, width sizes which include A4R and the like and which are 257 mm or less were a first width size group, width sizes which include A4 and the like and which are 297 mm or less were a second width size group, and width sizes which include 13 inch paper and the like exceeding A4 were a third width size group. Further, when large-sized sheets having a large width size are fed to some extent, fixing member surface contamination deposited at both widthwise end portions of small-sized sheets having sizes smaller in width size than the large-sized sheets is gradually removed by an image portion or the like of the large-sized sheets.

From this result, when an integrated feeding number of the large-sized sheets is not less than a predetermined sheet number as in steps S306, S309, the feeding counters for the small-sized sheets smaller in width size than the large-sized sheets are reset (S307, S310).

Then, by the feeding counters for the first to third width size groups, whether or not the cleaning mode for the fixing member is needed is discriminated. In the fixing device in this embodiment, it has been known that contamination sticking on the fixing member starts by sheet feeding of about 30000 sheets of the same-size paper. Therefore, by steps S401-S403, passing counters are discriminated, and on the basis of discrimination information, necessity of execution of the cleaning mode and the sheet width size are checked.

In this embodiment, by any of the width size counters, discrimination that the cleaning is needed is made in the case of 30000 sheets or more. However, depending on the type of the fixing device 6, for the reason that a tendency of so-called non-sheet-passing portion temperature rise of the sheet in the fixing device is different or the like reason, a threshold at which the cleaning is needed for each of the width size groups may also be changed.

Then, after the CPU 13 recognized that the execution of the cleaning mode is needed, the CPU 13 executes a control sequence set in the apparatus in advance. That is, the CPU 13 can automatically execute the cleaning mode during the printing or can prompt the user to perform the cleaning mode by displaying, on the screen portion 200*b* of the operating portion 200, that the cleaning is needed.

Thus, by effecting predictive control of accumulation of contamination of the fixing member by the inside counters, the user can efficiently execute the cleaning of the fixing member without contaminating a product and without uselessly wasting the printing sheets.

<Embodiment4>

Next, Embodiment 4 will be described. A basic constitution of this embodiment is similar to that in Embodiment 1. In this embodiment, cleaning at least the pressing roller 61 with the cleaning sheet is a feature of this embodiment. In the following, this embodiment will be specifically described.

(4-1) Cleaning Mode (Cleanup Mode)

In this embodiment, a cleaning sheet for cleaning the pressing roller 61 of the fixing device 6 is introduced by using the sheet shifting mechanism 3 provided in a side upstream of the transfer nip T with respect to the sheet feeding direction. Incidentally, in this embodiment, a constitution in which also the fixing roller 60 is cleaned in combination with the pressing roller 61.

That is, when at least two sheets are inserted into the nip in (an operation in) a cleaning mode described later, the sheet shifting mechanism 3 is used as a changing mechanism for changing relative positions of first and second sheets relative to the pressing roller 61 with respect to the widthwise direction of the pressing roller 61.

Figure 16:
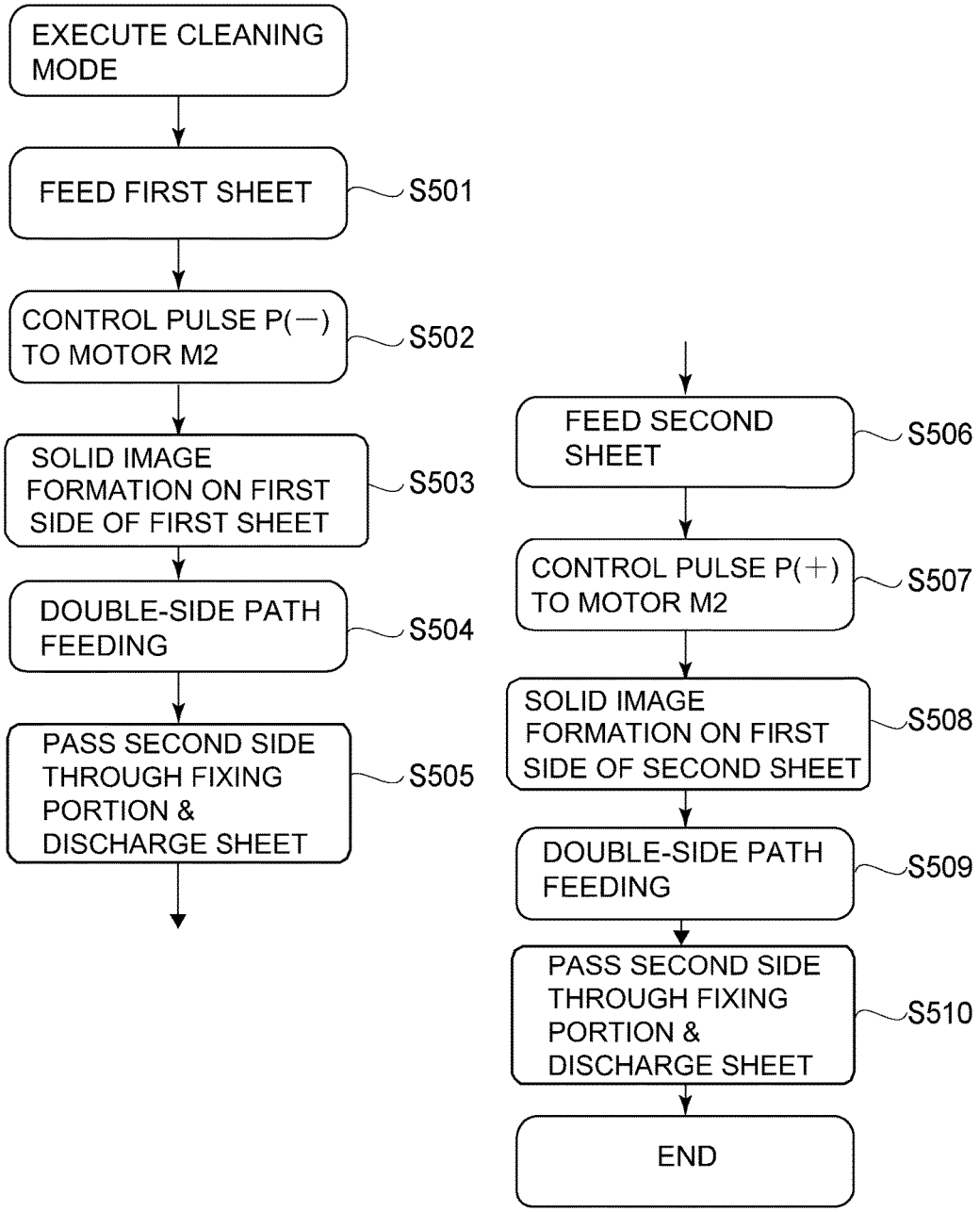
FIG. 16 is a sequence diagram relating to a cleaning mode in Embodiment 4.

FIG. 16 shows an execution flowchart of the cleaning mode of the fixing roller and the pressing roller in this embodiment. An execution instruction 300*a* of this mode is inputted into the CPU 13 by an execution key 200*a* on an operating portion 200 or a host device 300 such as an externally connected PC. The execution key 200*a* is a manual inputting means by which a user can arbitrarily input the execution instruction of the cleaning mode into the CPU 13.

Then, the CPU 13 operates the sheet feeding device 7, so that a single sheet P is fed to the image forming portion 5 (S501). As in this apparatus 1, in the case where there are a plurality of cassettes, as a sheet accommodating portion, as shown by 7*a* and 7*b*, feeding of the sheet can be performed in the following manner. That is, the user may be capable of selecting the cassette in advance of feeding of the sheet P during the execution of the cleaning mode or may also be capable of automatically selecting the sheet feeding cassette on the basis of procedure. In this embodiment, the sheet which is usable in the apparatus and which has a maximum width is fed.

Then, when the first sheet P reaches the shifting mechanism portion 3, the CPU 13 inputs a predetermined control pulse P(−) into the motor M2 and controls the shifting mechanism 3 so that the sheet P is shifted by 3 mm form a widthwise center toward the left side (L direction in FIG. 3) with respect to the widthwise direction (S502). Then, a whole-surface solid black image (predetermined toner image for cleaning) is formed on first side (surface) of this sheet P by the image forming portion 5, so that the sheet for cleaning (hereinafter referred to as a cleaning sheet) Pc is formed (S503).

At this time, image formation is effected so that left-and-right margin widths of this cleaning sheet Pc with respect to the widthwise direction are minimum, i.e., 2 mm in each of left-and-right sides in the apparatus 1. Incidentally, as regards leading and trailing end margins of the cleaning sheet Pc with respect to the feeding direction, these margins have no influence on the cleaning effect and therefore may be an arbitrary value, but were set at 10 mm in the mode of this embodiment.

Thus, the cleaning sheet Pc on which the solid black image is formed on the first side passes through the fixing device 6 in a state in which the cleaning sheet Pc is shifted toward the left side by 3 mm. By this, of contaminations deposited on the fixing roller surface at left-and-right end portions during the image formation, the left-side contamination contacts an image portion of the cleaning sheet Pc and is removed by being transferred on the cleaning sheet Pc side by a bonding force between toners (toner particles).

The CPU 13 introduces a first cleaning sheet Pc, passed through the fixing device 6, into the double-side feeding path (double-side path portion) 11 and turns the cleaning sheet Pc upside down, and returns the cleaning sheet Pc to the image forming portion 5 and feeds the cleaning sheet Pc (double-side feeding) (S504). At the image forming portion 5, the toner image is not formed on the second side of this cleaning sheet Pc, and the cleaning sheet Pc is passed through the transfer nip T as it is, and is introduced into the fixing device 6 (S505).

By the cleaning sheet Pc introduced again into the fixing nip N in a state in which the cleaning sheet Pc is turned upside down as described above and the image portion faces downward, left-side contamination of contaminations deposited on the pressing roller surface at left-and-right (both) end portions is transferred onto the cleaning sheet Pc side and is removed by the cleaning sheet Pc. Then, the first cleaning sheet Pc which is thus introduced again into the fixing nip portion N and which passes through the fixing nip N is discharged to the outside of the apparatus 1. Thus, of the contaminations deposited on the fixing roller 60 and the pressing roller 61, the left-side end portion contamination is removed by the image portion of the first cleaning sheet Pc.

Next, the CPU 13 feeds a second sheet P (S506) and inputs a predetermined control pulse P(+) into the motor M2, and effects control so that the sheet P is shifted by 3 mm toward the right side (R direction in FIG. 3) with respect to the widthwise direction from the widthwise center by the shifting mechanism 3 (S507). Then, on the first side of this second sheet, the whole-surface solid black image is formed by the image forming portion 5, so that a second cleaning sheet Pc is formed (S508).

Thus, the second cleaning sheet Pc on which the solid black image is formed on the first side passes through the fixing device 6 in a state in which the second cleaning sheet Pc is shifted toward the right side by 3 mm. By this, right-side contamination on the fixing roller surface is removed by the image portion of the second cleaning sheet.

The CPU 13 introduces the second cleaning sheet Pc, passed through the fixing device 6, into the double-side feeding path 11 and turns the cleaning sheet Pc upside down, and returns the cleaning sheet Pc to the image forming portion 5 and feeds the cleaning sheet Pc (double-side feeding) (S509). At the image forming portion 5, the toner image is not formed on the second side of this second cleaning sheet Pc, and the cleaning sheet Pc is passed through the transfer nip T as it is, and is introduced into the fixing device 6 (S510).

By the second cleaning sheet Pc introduced again into the fixing nip N in a state in which the second cleaning sheet Pc is turned upside down as described above and the image portion faces downward, right-side contamination on the pressing roller surface is transferred onto the cleaning sheet Pc side and is removed by the cleaning sheet Pc. Then, the second cleaning sheet Pc which is thus introduced again into the fixing nip portion N and which passes through the fixing nip N is discharged to the outside of the apparatus 1. Thus, of the contaminations deposited on the fixing roller 60 and the pressing roller 61, the right-side end portion contamination is removed by the image portion of the second cleaning sheet Pc. Thus, the cleaning mode is ended.

Figure 17:
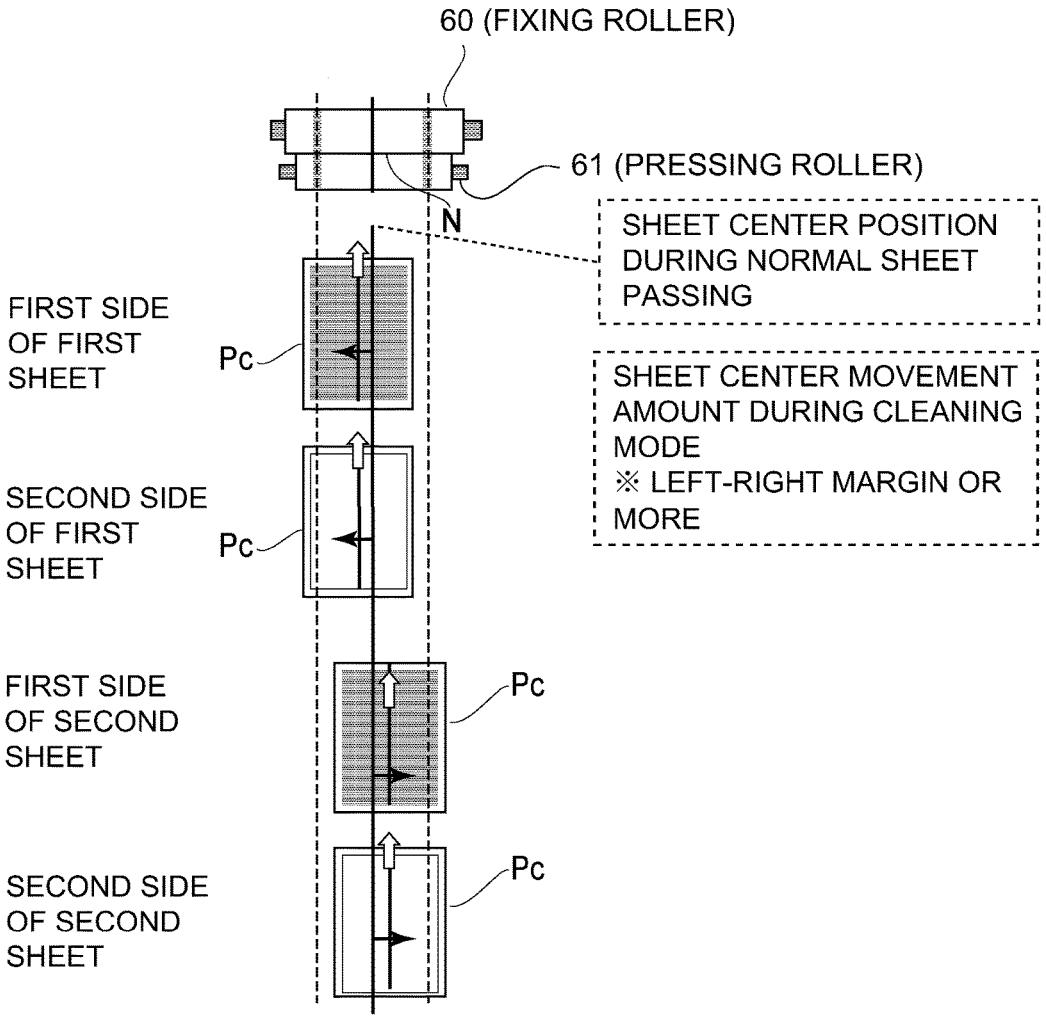
FIG. 17 is an illustration relating to a feeding position of a cleaning sheet in Embodiment 4.

Thus, in this embodiment, as shown in FIG. 17, the two cleaning sheets pc are passed four times in total through the nip N through double-side feeding, so that it is possible to remove (clean) the contaminations deposited on the fixing roller 60 and the pressing roller 61 at the left-and-right (both) end portions.

A cleaning execution constitution of the fixing device 6 described above in this Embodiment 1 is summarized as follows. The executing portion 13 for executing the cleaning mode in which the cleaning sheet Pc on which the predetermined image is formed on the first side by the image forming portion 5 is inserted and passed through the nip N and thereafter this sheet is reversed (turned upside down) and is inserted and passed through the nip N again and thus the cleaning sheet cleans the pressing roller 61 is provided. Further, the changing mechanism 3 for changing relative positions of the first sheet and the second sheet relative to the pressing roller 61 with respect to the widthwise direction of the pressing roller 61 when at least two sheets are inserted and passed through the nip N in the cleanup mode is provided.

In the above-described cleaning mode, a change amount of the relative position is larger than a minimum margin width, in one end side and the other end side with respect to the widthwise direction, of the sheet selectable during the image formation.

Further, in order to alleviate the abrasion of surfaces of both of the fixing and pressing rollers 60, 61 due to burrs at the widthwise end portions of the sheet P, in the case where the relative position between the fixing nip N and the sheet P with respect to the widthwise direction is shifted every sheet by controlling the shifting mechanism 3, the following control may be carried out.

As regards the control pulse number of the motor M2, a control pulse number P during the image formation is used in a range of Pmin-Pmax. On the other hand, control pulse numbers P(−), P(+) used during the cleaning mode are set so as to provide relationships of P(−)<Pmin, P(+)>Pmax.

By this, outside the region through which the sheet P passes during the image formation, the cleaning sheet pc can be passed, so that the unfixed toner image on the cleaning Pc can contact toner contamination with reliability and thus it is possible to remove the toner contamination.

<Embodiment5>

Figure 18:
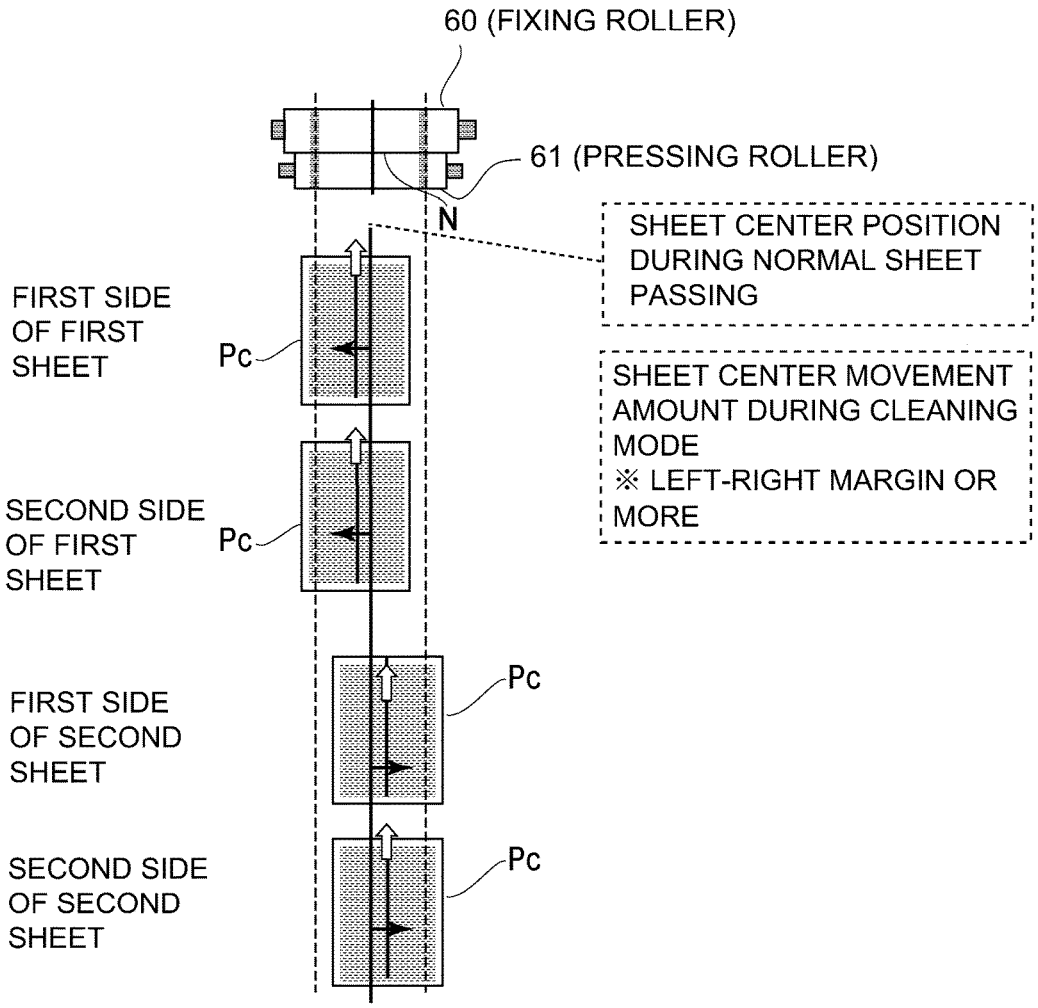
FIG. 18 is an illustration relating to a feeding position of a cleaning sheet in Embodiment 5.

A feature of a cleaning mode in this Embodiment 5 is, as shown in FIG. 18, that solid images are formed on both sides of two cleaning sheets similarly as in Embodiment 4.

That is, the executing portion 13 executes a cleanup mode (cleaning mode) for cleaning the heating roller 60 by the following control in the cleanup mode. That is, when first and second sheets on which a predetermined image is formed on the respective first sides by the image forming portion 5 are inserted and passed through the nip N, relative positions of the first and second sheets to the heating roller 60 with respect to the widthwise direction of the heating roller 60 are changed by the changing mechanism 3. Change amounts of the relative positions are larger than minimum margin widths of the sheet, in one end side and the other end side with respect to the widthwise direction, selectable during the image formation.

In Embodiment 1, the solid image is formed only on the first side, and the solid image portion on one side is passed two times through the nip N, so that the surface contamination of both of the fixing roller 60 and the pressing roller 61 was removed. As in this Embodiment 2, when the solid image is further formed on the second side, in the fixing roller side, the image surface of the cleaning roller contacts the fixing roller two times, so that the fixing roller can be cleaned. For that reason, it is possible to remove also the contamination remaining on the fixing roller without being not completely removed by single sheet feeding, so that it is possible to more effectively clean the fixing roller and the pressing roller.

Embodiment 6>

Figure 19:
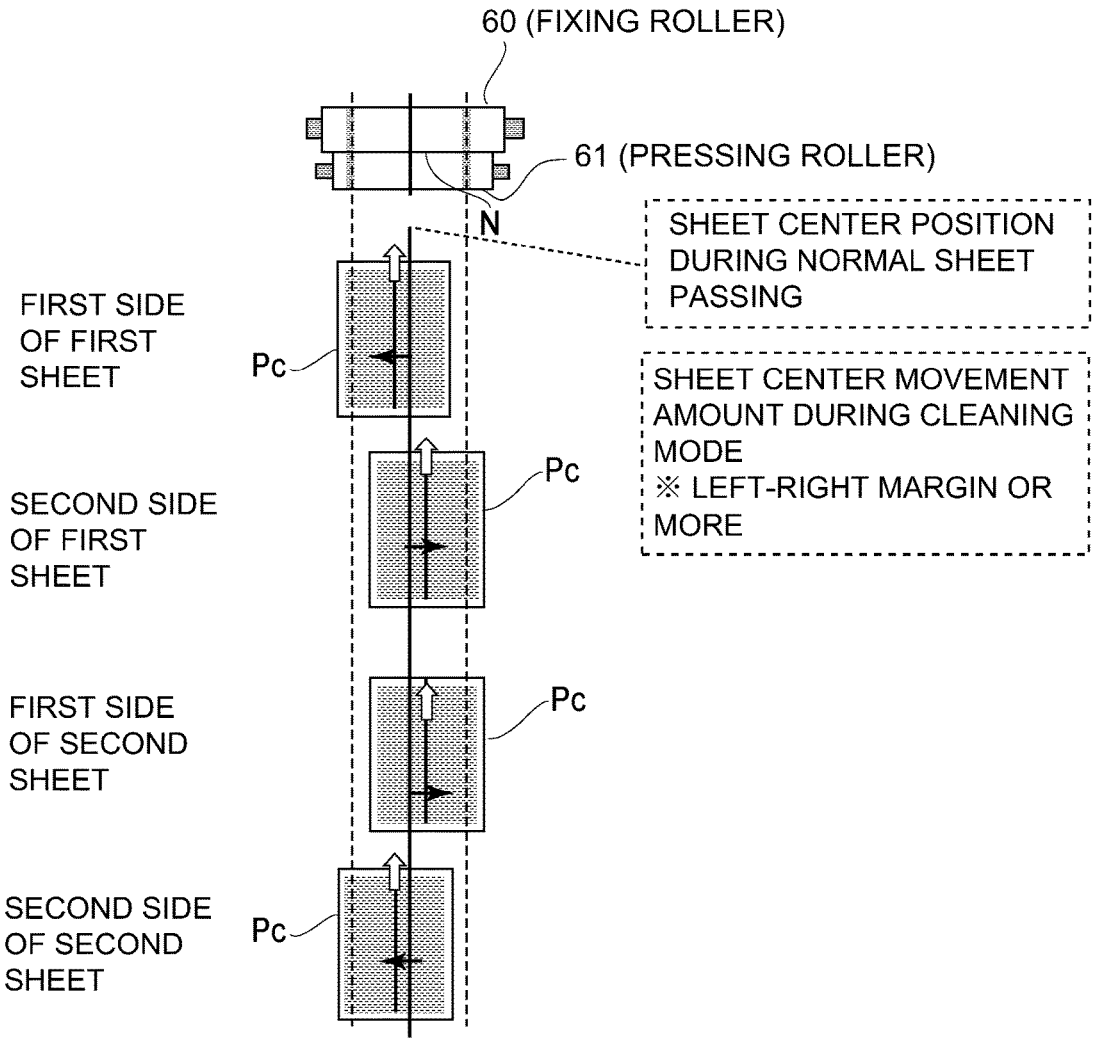
FIG. 19 is an illustration relating to a feeding position of a cleaning sheet in Embodiment 6.

In a cleaning mode in this Embodiment 6, as shown in FIG. 19, similarly as in Embodiments 4 and 5, double-side two cleaning sheets Pc and fed, while the widthwise feeding positions of the cleaning sheets Pc are further devised. By this, particularly the end portion surface contaminations of the pressing roller 61 can be effectively removed (cleaned).

Figure 20:
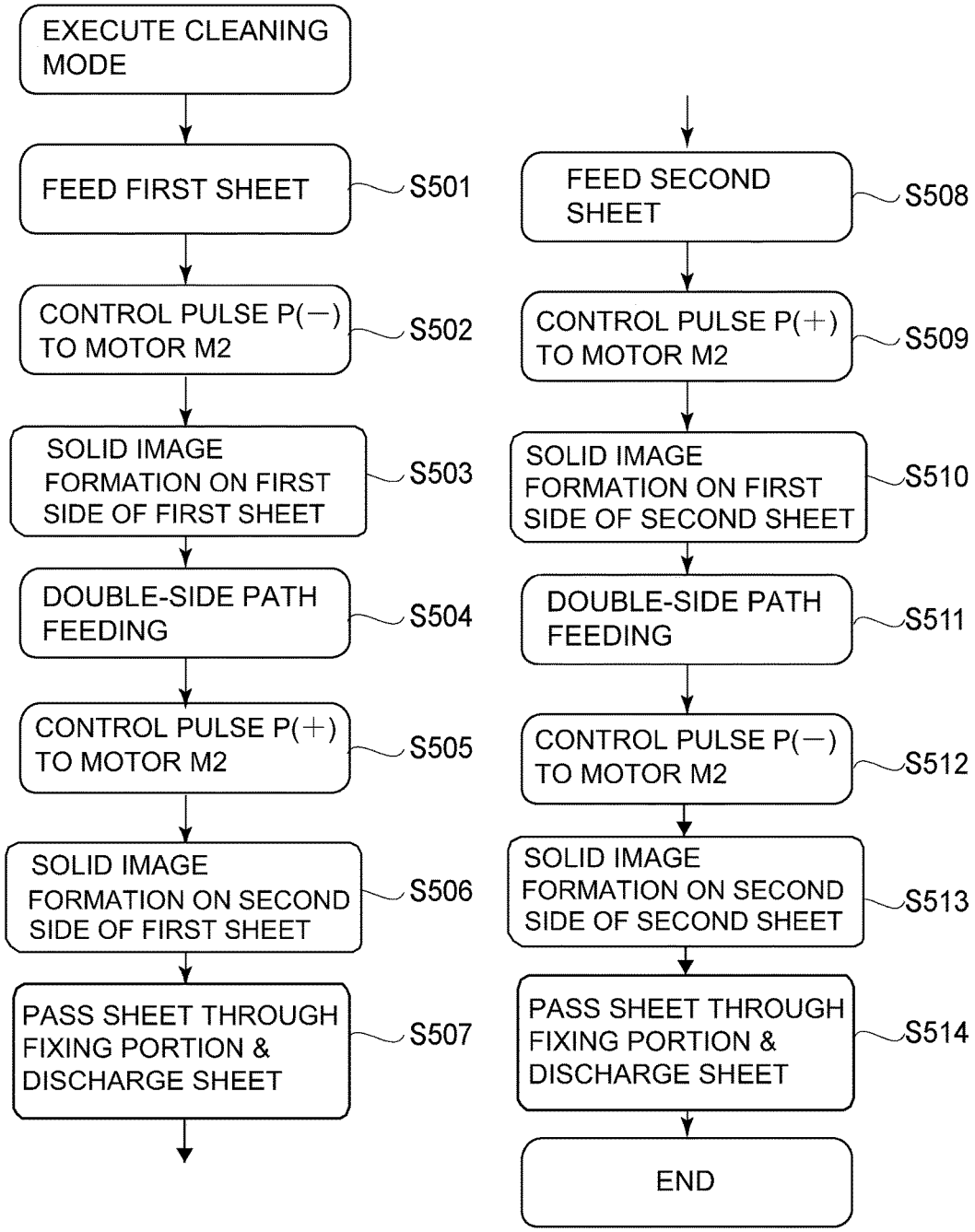
FIG. 20 is a sequence diagram relating to a cleaning mode in Embodiment 6.

FIG. 20 shows a flow in this embodiment. When the cleaning mode is executed, the first sheet is fed from the sheet feeding device 7 (S501). In this embodiment, as regards the first side of this first sheet, the shifting mechanism 3 is controlled so that the sheet is shifted toward the left side by inputting the predetermined control pulse P(−) into the motor M2 (S502). Then, a solid image is formed on the first side of the first sheet (S503). This cleaning sheet Pc is introduced into the fixing device 6, so that the contamination of the fixing roller 60 in the left-side end portion is removed.

The CPU 13 introduces the first cleaning sheet Pc, passed through the fixing device 6, into the double-side feeding path 11 and turns the first cleaning sheet Pc upside down, and feeds the first cleaning sheet Pc for double-side printing (S504). The cleaning sheet passed through the double-side feeding path 11 is supplied again to the shifting mechanism portion 3. Here, as regards the second side of the first sheet as the cleaning sheet, the shifting mechanism 3 is controlled so that the sheet is shifted toward the right side by inputting the predetermined control pulse P(+) into the motor M2 (S505). This sheet is introduced again into the transfer nip T of the image forming portion 5, so that a solid image is formed on the second side (S506).

This cleaning sheet Pc is introduced into the fixing device 6 (S507). By this, the right end portion-side contamination of the fixing roller 60 is removed by the image portion of the second side of the cleaning sheet Pc, and the right end portion-side contamination of the pressing roller 61 is removed by the image portion of the first side, facing downward, of the cleaning sheet Pc. The first cleaning sheet Pc passed through the fixing device 6 is discharged to the outside of the apparatus 1.

Then, the CPU 13 feeds the second sheet P (S508). As regards the first side of this second sheet, the shifting mechanism 3 is controlled so that the sheet is shifted in reverse procedure to that of the first side of the first sheet, i.e., the first side of the second sheet is shifted toward the right side by inputting the predetermined control pulse P(+)

into the motor M2 (S509). Then, a solid image is formed on the first side of this second sheet (S510). This cleaning sheet Pc is introduced into the fixing device 6, so that the cleaning of the fixing roller 60 in the right-side end portion side is carried out again.

The CPU 13 introduces the second cleaning sheet Pc, passed through the fixing device 6, into the double-side feeding path 11 and turns the first cleaning sheet Pc upside down, and feeds the first cleaning sheet Pc for double-side printing (S511). The cleaning sheet passed through the double-side feeding path 11 is supplied again to the shifting mechanism portion 3. Here, as regards the second side of the second sheet as the cleaning sheet, the shifting mechanism 3 is controlled so that the sheet is shifted toward the left side by inputting the predetermined control pulse P(−) into the motor M2 (S512). This sheet is introduced again into the transfer nip T of the image forming portion 5, so that a solid image is formed on the second side (S513).

This cleaning sheet Pc is introduced into the fixing device 6 (S514). By this, the left end portion-side cleaning of the fixing roller 60 is carried out by the image portion of the second side of the cleaning sheet Pc, and the left end portion-side contamination of the pressing roller 61 is removed by the image portion of the first side, facing downward, of the cleaning sheet Pc. The first cleaning sheet Pc passed through the fixing device 6 is discharged to the outside of the apparatus 1. Thus, the cleaning mode is ended.

The above-described cleaning mode is summarized as follows. The cleaning mode is a mode in which by one execution instruction, at least two sheets on which the solid image is formed on their first sides at the image forming portion 5 are subjected to double-side feeding and are passed four times in total through the above-described nip N. Further, with respect to the nip N of the sheet as regards, respective relationships between:

1) a passing position of the first side of the first sheet and a passing position of the second side of the second sheet,
2) a passing position of the first side of the second sheet and a passing position of the second side of the second sheet, and
3) the passing position of the second side of the first sheet and the passing position of the second side of the second sheet, the shifting mechanism (position control mechanism) 3 is controlled so that the sheet is moved in an opposite widthwise direction by a predetermined amount relative to the passing position of the sheet through the nip N during normal image formation.

Thus, the first and second cleaning sheets are fed by shifting the feeding positions of the first side and the second side in the respective opposite directions. By this, when the second side of the surface passes through the fixing nip N, i.e., when the pressing roller 61 side is cleaned, the pressing belt surface contamination can be removed (cleaned) with reliability by the presence of an always fresh toner image surface in the side back surface side in a longitudinal position side intended to be cleaned.

A cleaning execution constitution of the fixing device 6 in this Embodiments 5 and 6 is summarized as follows. The sheet on which the predetermined image is formed on the first side by the image forming portion 5 is inserted and passed through the nip N and thereafter this sheet is reversed (turned upside down), and the recording material on which a predetermined image is formed on the second side by the image forming portion 5 is inserted and passed through the nip N again. By this, the executing portion 13 for executing the cleanup mode in which the pressing roller 61 is cleaned is provided. The changing mechanism 3 for changing relative positions of the first sheet material and the second sheet material relative to the pressing roller 61 with respect to the widthwise direction of the pressing roller 61 when at least two recording materials are inserted and passed again through the nip N in the cleanup mode is provided.

Further, the executing portion 13 changes the above-described relative positions of the first and second sheets by the changing mechanism 3 when the first and second sheets on which the predetermined image is formed on the respective first sides by the image forming portion 5 is inserted and passed through the nip. By this, the heating roller is cleaned.

A change amount of the relative position is larger than a minimum margin width, in one end side and the other end side with respect to the widthwise direction, of the sheet selectable during the image formation.

<Embodiment7>

In this embodiment, in an image forming apparatus including a fixing device 6 of a belt type shown in FIGS. 11A-E, similarly as Embodiment 4, a sheet Pc for cleaning is fed using the sheet shifting mechanism 3 provided upstream of the transfer nip T. (7-1) Cleaning mode <shift amount in view of shift positions of fixing belt and pressing belt> Also in the belt type fixing device 6 employed in this embodiment, as regards a flow when cleaning of the fixing belt and the pressing belt is executed, the cleaning mode is executed on the basis of the flow of FIG. 16.

However, widthwise positions (longitudinal positions) of the fixing belt 130 and the pressing belt 120 are moved by the shift control, and therefore, a widthwise feeding position of the cleaning sheet Pc may preferably be taken into consideration in order to obtain a cleaning effect. That is, in the case where the fixing belt 130 and the pressing belt 120 are shifted in the widthwise direction by the shift control, the cleaning effect by the cleaning sheet Pc is prevented from being lost by the shift. For that reason, there is a need that a one-side movement amount of the cleaning sheet Pc with respect to the widthwise direction may preferably be determined by taking one-side movement amounts and one-side minimum margins of the fixing belt 130 and the pressing belt 120 into consideration.

In this embodiment, the one-side movement amounts of the fixing belt 130 and the pressing belt 120 are 1.5 mm, and therefore toner contamination of 3 mm in width generates on the surfaces of the fixing belt 130 and the pressing belt 120. Further, the one-side minimum margin is 2 mm, and therefore the one-side movement amount of the cleaning sheet Pc was set at 5.5 mm so as to be not less than 5.0 mm. By doing so, in any state when the fixing belt 130 and the pressing belt 120 perform a reciprocal shift operation in the widthwise direction by the shift control, the widthwise position of the cleaning sheet Pc is shifted toward both ends by 5.5 mm and passes through the fixing belt and the pressing belt. By this, the toner contamination on the fixing belt and the pressing belt can be removed (cleaned) with reliability.

Further, as another method, the widthwise positions of the fixing belt and the pressing belt are discriminated by the CPU 13, and the cleaning sheet pc can be passed through the fixing belt and the pressing belt at timing when the cleaning effect is more achieved. That is, when the cleaning sheet Pc is shifted toward the left side with respect to the widthwise direction and is passed through the fixing nip N6, the control is effected so that the cleaning sheet Pc is passed through the fixing nip N6 at timing when of the fixing belt and the pressing belt, a member intended to particularly attach importance to the cleaning is positioned in the left surface with respect to the widthwise direction. On the other hand, when the cleaning sheet Pc is shifted toward the right side with respect to the widthwise direction and is passed through the fixing nip N6, the control is effected so that the cleaning sheet Pc is passed through the fixing nip N6 at timing when of the fixing belt and the pressing belt, a member intended to particularly attach importance to the cleaning positioned in the right surface with respect to the widthwise direction.

By doing so, it is possible to more effectively remove the toner contamination deposited on the fixing belt 130, outside a normal feeding position.

Further, as further another method, a method in which the cleaning mode is executed by moving the fixing belt 130, by the shift control mechanism (fixing member for control mechanism), so as to change only the widthwise positions of the fixing belt and the pressing belt without changing the feeding position of the sheet P would be considered.

In this case, compared with at least a normal operation, movement widths of the fixing belt and the pressing belt may preferably be increased. For that reason, the shift control mechanism is complicated. Further, there is a possibility that the fixing belt and the pressing belt are completely shifted (to an end) and are broken. Further, it takes time that the fixing belt and the pressing belt reciprocate between both ends with respect to the widthwise direction, and therefore a time required to carry out the cleaning becomes long. From this result, even in the fixing device of the belt type, feeding of the cleaning sheet Pc may preferably be controlled by the sheet shifting mechanism 3 as in this embodiment.

Further, in order to change relative positions between the rotatable fixing member and the rotatable pressing member, and the cleaning sheet Pc, as an alternative method for moving the rotatable fixing member, and the rotatable pressing member, a mechanism (fixing member position control mechanism) for reciprocating the fixing device (rotatable fixing member and rotatable pressing member) itself is provided. Further, there is also a method for feeding the cleaning sheet Pc in synchronism with the reciprocating operation. In this method, compared with the case where the cleaning sheet Pc is fed in synchronism with the shift control of the fixing belt and the pressing belt, the fixing device 6 can be moved to a desired position and stopped at the position, so that a harmful influence thereon is small.

A cleaning execution constitution of the fixing device 6 described above is summarized as follows. The changing mechanism for changing relative positions of the first sheet and the second sheet relative to the fixing belt or the pressing belt in the cleanup mode is provided. As the changing mechanism, both of the fixing image position control mechanism and the sheet shifting mechanism (recording material position control mechanism) 3 which are capable of moving the rotatable heating member or the rotatable pressing member in the widthwise direction are provided. Further, a maximum movement amount of the sheet shifting mechanism 3 in the widthwise direction is larger than a maximum movement amount, with respect to the widthwise direction, of the fixing member position control mechanism.

<Embodiment8>

In Embodiments 4-7, the cleaning mode was described as the cleaning mode, for the rotatable fixing member and the rotatable pressing member, which can be arbitrarily executed when a user feels necessity of the cleaning of the fixing device. On the other hand, a control constitution in which a control mode for automatically executing the cleaning mode is set in the image forming apparatus in advance or in which a recommendation message for prompting the user to execute the cleaning mode as needed is displayed on a screen portion 200*b* (FIG. 8) of the operating portion 200 may also be used.

In this embodiment, a cleaning counter (discriminating means for discriminating a degree of contamination of the surfaces of the rotatable fixing member and the rotatable pressing member) 16 (FIG. 8) will be described. FIG. 14 and FIG. 15 are sequence diagrams relating to the cleaning counter 16.

When the sheet P is fed by the sheet feeding mechanism 7 during normal printing, the CPU 13 checks a width size of the sheet P registered in advance (S301). Further, by steps S302, S304, a feeding counter grouped depending on the width size is read, and 1 is counted up per one feeding (S303, S305, S308).

Here, width sizes which include A4R and the like and which are 257 mm or less were a first width size group, width sizes which include A4 and the like and which are 297 mm or less were a second width size group, and width sizes which include 13 inch paper and the like exceeding A4 were a third width size group. Further, when large-sized sheets having a large width size are fed to some extent, rotatable fixing member and rotatable pressing member surface contaminations deposited at both widthwise end portions of small-sized sheets having sizes smaller in width size than the large-sized sheets is gradually removed by an image portion or the like of the large-sized sheets.

From this result, when an integrated feeding number of the large-sized sheets is not less than a predetermined sheet number as in steps S306, S309, the feeding counters for the small-sized sheets smaller in width size than the large-sized sheets are reset (S307, S310).

Then, by the feeding counters for the first to third width size groups, whether or not the cleaning mode for the rotatable fixing member and the rotatable pressing member is needed is discriminated. In the fixing device in this embodiment, it has been known that contamination sticking on the rotatable fixing member and the rotatable pressing member starts by sheet feeding of about 30000 sheets of the same-size paper. Therefore, by steps S401-S403, passing counters are discriminated, and on the basis of discrimination information, necessity of execution of the cleaning mode and the sheet width size are checked.

In this embodiment, by any of the width size counters, discrimination that the cleaning is needed is made in the case of 30000 sheets or more. However, depending on the type of the fixing device 6, for the reason that a tendency of so-called non-sheet-passing portion temperature rise of the sheet in the fixing device is different or the like reason, a threshold at which the cleaning is needed for each of the width size groups may also be changed.

Then, after the CPU 13 recognized that the execution of the cleaning mode is needed, the CPU 13 executes a control sequence set in the apparatus in advance. That is, the CPU 13 can automatically execute the cleaning mode during the printing or can prompt the user to perform the cleaning mode by displaying, on the screen portion 200*b* of the operating portion 200, that the cleaning is needed.

Thus, accumulation of contamination of the fixing member is subjected to predictive control by the inside counters. By this, the user can efficiently execute the cleaning of the rotatable fixing member and the rotatable pressing member without contaminating a product and without uselessly wasting the printing sheets.

Incidentally, the sheet fed as the cleaning sheet may be not the sheet having a maximum width size usable in the apparatus, but may also be a sheet having a width smaller than the maximum width.

Further, the image forming portion 5 for forming the unfixed toner image K on the recording material P is not limited to the image forming portion using an electrophotographic process. The image forming portion 5 may also be those using an electrostatic recording process and a magnetic recording process, respectively. The image forming portion 5 may also be the image forming portion for forming a color image. The type of the image forming portion is not limited to the transfer type, but may also be a direct type in which the toner image is formed using photosensitive paper or electrostatic recording paper as the recording material.

INDUSTRIAL APPLICABILITY

According to the present invention, there is provided the image forming apparatus capable of effectively cleaning the rotatable heating member.

The invention claimed is:

1. An image forming apparatus comprising:

an image forming portion forming a toner image on a sheet;

a rotatable heating member and a rotatable pressing member for fixing, at a nip, the toner image formed on the sheet by said image forming portion;

an executing portion for executing a cleaning mode for cleaning said rotatable heating member by introducing, into the nip, the sheet on which a predetermined toner image is formed by said image forming portion;

a re-introducing mechanism for re-introducing the sheet, into the nip, which has passed through the nip and then has been turned upside down; and a shifting mechanism for shifting a sheet position so that when a single sheet is introduced twice into the nip in the cleaning mode by using said re-introducing mechanism, positional relationships of a first-time sheet and a second-time sheet relative to said rotatable heating member with respect to a widthwise direction of said rotatable heating member are made different from each other.

2. An image forming apparatus according to claim 1, wherein said image forming portion forms, as the predetermined toner image, the toner image in an entire image formable region of the sheet with respect to the widthwise direction.

* * * * *